US007709171B2

(12) United States Patent
Yamamoto et al.

(10) Patent No.: US 7,709,171 B2
(45) Date of Patent: May 4, 2010

(54) CHARGE CONTROL AGENT, TONER AND TONER PRODUCING METHOD

(75) Inventors: Atsushi Yamamoto, Kawanishi (JP); Chiyoshi Nozaki, Otsu (JP); Tsuyoshi Nozaki, Ikeda (JP); Mitsuyo Matsumoto, Ibaraki (JP); Katsunori Kurose, Takarazuka (JP)

(73) Assignee: Ricoh Company, Ltd., Tokyo (JP)

( * ) Notice: Subject to any disclaimer, the term of this patent is extended or adjusted under 35 U.S.C. 154(b) by 319 days.

(21) Appl. No.: 11/779,648

(22) Filed: Jul. 18, 2007

(65) Prior Publication Data

US 2008/0032223 A1 Feb. 7, 2008

(30) Foreign Application Priority Data

Aug. 2, 2006 (JP) ..... 2006-211457

(51) Int. Cl.
*G03G 9/097* (2006.01)

(52) U.S. Cl. ..... 430/108.1; 430/125.3; 430/137.15

(58) Field of Classification Search ..... 430/109.4, 430/124, 108.1, 125.3, 137.15
See application file for complete search history.

(56) References Cited

U.S. PATENT DOCUMENTS

| | | | | |
|---|---|---|---|---|
| 5,728,501 | A * | 3/1998 | Nakanishi et al. | 430/108.22 |
| 6,733,939 | B2 * | 5/2004 | Nanya et al. | 430/108.22 |
| 2006/0204882 | A1 | 9/2006 | Nozaki et al. | |
| 2006/0210902 | A1 | 9/2006 | Nakamura et al. | |
| 2006/0275686 | A1 | 12/2006 | Kadota et al. | |
| 2007/0026335 | A1 | 2/2007 | Yamamoto et al. | |
| 2007/0059625 | A1 | 3/2007 | Yamamoto et al. | |

FOREIGN PATENT DOCUMENTS

| | | |
|---|---|---|
| JP | 63-184762 | 7/1988 |
| JP | 2-110472 | 4/1990 |
| JP | 7-72808 | 8/1995 |
| JP | 8-95305 | 4/1996 |
| JP | 11-218965 | 8/1999 |
| JP | 2979222 | 9/1999 |
| JP | 2987612 | 10/1999 |
| JP | 2001-255677 | 9/2001 |
| JP | 2002-278160 | 9/2002 |
| JP | 2002-278164 | 9/2002 |
| JP | 2002-304023 | 10/2002 |
| JP | 2002-351133 | 12/2002 |
| JP | 2003-21934 | 1/2003 |
| JP | 2003-57876 | 2/2003 |
| JP | 2003-57878 | 2/2003 |
| JP | 2003-57880 | 2/2003 |
| JP | 2003-98752 | 4/2003 |
| JP | 2003-140401 | 5/2003 |
| JP | 2004-117461 | 4/2004 |
| JP | 3550638 | 5/2004 |
| JP | 2004-163836 | 6/2004 |
| JP | 2004-245948 | 9/2004 |
| JP | 2004-317710 | 11/2004 |
| JP | 2005-70464 | 3/2005 |

OTHER PUBLICATIONS

U.S. Appl. No. 11/624,525, filed Jan. 18, 2007, Hideaki Yasunaga, et al.
U.S. Appl. No. 11/681,530, filed Mar. 2, 2007, Takuya Kadota, et al.
U.S. Appl. No. 11/674,244, filed Feb. 13, 2007, Minoru Nakamura, et al.

* cited by examiner

*Primary Examiner*—John L Goodrow
(74) *Attorney, Agent, or Firm*—Oblon, Spivak, McClelland, Maier & Neustadt, L.L.P.

(57) ABSTRACT

The present invention provides a charge control agent, adapted to control charging ability of resins or compositions containing resins, comprising a copolymer that comprises a polymer block A and a polymer block B, the polymer block A is prepared by copolymerizing a maleimide, which being unsubstituted or substituted for a hydrogen atom of an imide group by an electron-donating group, and styrene or a styrene derivative, and the polymer block B is formed of a polymer of styrene or a styrene derivative.

10 Claims, 2 Drawing Sheets

CHARGE CONTROL AGENT, TONER AND TONER PRODUCING METHOD

BACKGROUND OF THE INVENTION

1. Field of the Invention

The present invention relates to charge control agents, toners containing the charge control agents, and toner producing methods.

2. Description of the Related Art

The processes to develop electrostatic images using toners in image forming apparatuses like electrophotography are broadly classified into two; that is, processes that utilize two-component developers in which toners and carriers are mixed and processes that utilize one-component developers containing only toners. In the processes by use of the two-component developers, a toner and a carrier are stirred and charged into different polarities, and the charged toner visualizes electrostatic images having reverse polarity thereof; specific examples are magnet brush processes by use of iron-powder carriers, cascade processes by use of beads carriers and fur brush processes. The processes by use of the one-component developers are exemplified by powder cloud processes in which toners are used in a spray condition, contact development processes in which toners are directly contacted with latent electrostatic images and developed, non-contact development processes in which latent electrostatic images are developed by slightly separated toners, etc.

The toners applied in theses developing processes contain a colorant such as carbon black and pigments dispersed into binder resins. Magnetic toners are also conventional that contain these ingredients and further a magnetic material like magnetites. As described above, toners used in various developing processes are positively or negatively charged depending on the polarity of electrostatic images to be developed. In order to charge toners, the charging ability of resins in the toners may be made use of; however, the charging ability is typically insufficient when arising solely therefrom, thus the resulting images tend to be foggy and unclear. Therefore, charge control agents are typically included into the binder resins in addition to the colorants in order to provide toners with an intended charging ability. Conventional charge control agents with negative polarity are exemplified by metal complexes of mono azo dyes, nitrofumic acid and salts thereof; metal complexes of acids such as salicylic acid, naphthoic acid and dicarboxylic acid and metals such as zinc, aluminum, cobalt, chromium and iron; sulfonated copper phthalocyanine pigments, etc.

However, the charge control agents described above are typically of complex structure and inconsistent properties, lack stability, and often change their charging ability depending on environments. Moreover, most of the metal complexes are color compounds, which thus tend to affect adversely color reproducibility of colorants in developed images when used in color toners. Furthermore, compounds with heavy metals should often be addressed in terms of their influence on safety and environment.

Therefore, various polymer compounds have been proposed as charge control agents containing no metal. For example, Japanese Patent Application Laid-Open (JP-A) No. 63-184762 discloses a copolymer of styrene and acrylamide with a sulfonic acid group; JP-A No. 2003-98752 discloses a copolymer of a monomer with a sulfonic acid group and a halogen-substituted phenylmaleimide. However, the toners containing these polymer compounds are not sufficiently improved with respect to the tendency to decrease their charge amount under high temperature and high humidity conditions. In addition, JP-A No. 08-95305 reports that a copolymer of phenylmaleimide substituted by an electron attractive group such as halogen and nitro group is used for a charge control agent. However, this charge control agent is also insufficient in rating property of charging ability and stability of charge amount. Japanese Patent No. 3550638 discloses a copolymer of N-substituted maleimide and methylstyrene as a maleimide-styrene copolymer. The copolymer is disclosed merely as to a secondary nonlinear optical property with proper thermal stability.

BRIEF SUMMARY OF THE INVENTION

It is an object of the present invention to provide a charge control agent that can be used for toners with excellent rating property of charging ability and superior stability of charge amount.

It is another object of the present invention to provide a toner that is excellent in rating property of charging ability and superior in stability of charge amount.

It is still another object of the present invention to provide a method for producing a toner that is excellent in rating property of charging ability and superior in stability of charge amount.

It is still another object of the present invention to provide a copolymer usable as a charge control agent of a toner that is excellent in rating property of charging ability and superior in stability of charge amount.

It is still another object of the present invention to provide a toner-supplying cartridge for image forming apparatuses that contains a toner excellent in rating property of charging ability and superior in stability of charge amount.

It is still another object of the present invention to provide a process cartridge for image forming apparatuses that is excellent in rising property of developing ability and superior in stability.

It is still another object of the present invention to provide an image forming apparatus that is excellent in rising property of developing ability and superior in stability.

It is still another object of the present invention to provide an image forming method that is excellent in rising property of developing ability and superior in stability.

The inventive charge control agent, which is adapted to control charging ability of resins or compositions containing resins, comprises a copolymer that comprises a polymer block A and a polymer block B, the polymer block A is prepared by copolymerizing a maleimide, which being unsubstituted or substituted for a hydrogen atom of an imide group by an electron-donating group, and styrene or a styrene derivative, and the polymer block B is formed of a polymer of styrene or a styrene derivative.

The electron-donating group is a hydrocarbon group, for example. The copolymer may further comprise a polymer block C that is different from the polymer blocks A and B.

The inventive copolymer comprises a copolymer that has the polymer block A prepared by copolymerizing a maleimide, which being unsubstituted or substituted for a hydrogen atom of an imide group by an electron-donating group, and styrene or a styrene derivative, and the polymer block B formed of a polymer of styrene or a styrene derivative. The copolymer may further comprise a polymer block C that is different from the polymer blocks A and B.

The inventive toner comprises a binder resin, a colorant and a charge control agent, the charge control agent comprises a copolymer that comprises a polymer block A and a polymer block B, the polymer block A is prepared by copolymerizing a maleimide, which being unsubstituted or substituted for a hydrogen atom of an imide group by an electron-donating group, and styrene or a styrene derivative, and the polymer block B is formed of a polymer of styrene or a styrene derivative.

The electron-donating group is a hydrocarbon group, for example. The content of the charge control agent is preferably 1% by mass to 20% by mass.

The inventive toner producing method comprises dispersing toner materials comprising a charge control agent, a binder resin and a colorant into water or an aqueous dispersing medium, and agglomerating and fusing the dispersion of toner materials that are dispersed into the water or the aqueous dispersing medium, wherein the charge control agent comprises a copolymer that comprises a polymer block A and a polymer block B, the polymer block A is prepared by copolymerizing a maleimide, which being unsubstituted or substituted for a hydrogen atom of an imide group by an electron-donating group, and styrene or a styrene derivative, and the polymer block B is formed of a polymer of styrene or a styrene derivative.

The inventive toner producing method, in another aspect, comprises dissolving or dispersing toner materials containing a charge control agent, a binder resin and a colorant into an organic solvent to prepare a solution or a dispersion, dispersing the solution or the dispersion into water or an aqueous dispersing medium, and agglomerating and fusing the toner materials within the water or the aqueous dispersing medium; wherein the charge control agent comprises a copolymer that comprises a polymer block A and a polymer block B, the polymer block A is prepared by copolymerizing a maleimide, which being unsubstituted or substituted for a hydrogen atom of an imide group by an electron-donating group, and styrene or a styrene derivative, and the polymer block B is formed of a polymer of styrene or a styrene derivative.

The inventive toner producing method, in still another aspect, comprises a first step of dissolving or dispersing a charge control agent into a monomer of binder raw material, introducing the resulting solution or dispersion into water or an aqueous solvent to emulsify the monomer, a second step to prepare an emulsion of a polymer containing the charge control agent through polymerizing the monomer in the emulsion, and a third step of dispersing a colorant and agglomerating and fusing the polymer containing the charge control agent and the dispersed colorant; wherein the charge control agent comprises a copolymer that comprises a polymer block A and a polymer block B, the polymer block A is prepared by copolymerizing a maleimide, which being unsubstituted or substituted for a hydrogen atom of an imide group by an electron-donating group, and styrene or a styrene derivative, and the polymer block B is formed of a polymer of styrene or a styrene derivative.

The inventive toner producing method, in still another aspect, comprises a first step of dissolving or dispersing a charge control agent into a monomer of binder raw material, introducing the resulting solution or dispersion into water or an aqueous solvent to polymerize the monomer, a second step to prepare a suspension of a polymer containing the charge control agent through polymerizing the monomer in the suspension, and a third step of dispersing a colorant and agglomerating and fusing the polymer containing the charge control agent and the dispersed colorant; wherein the charge control agent comprises a copolymer that comprises a polymer block A and a polymer block B, the polymer block A is prepared by copolymerizing a maleimide, which being unsubstituted or substituted for a hydrogen atom of an imide group by an electron-donating group, and styrene or a styrene derivative, and the polymer block B is formed of a polymer of styrene or a styrene derivative.

The inventive toner producing method, in still another aspect, comprises a first step of mixing toner materials containing a charge control agent, a binder resin and a colorant to prepare a mixture, a second step of melting-kneading the mixture to prepare a kneaded product, and a third step of milling-classifying the kneaded product; wherein the charge control agent comprises a copolymer that comprises a polymer block A and a polymer block B, the polymer block A is prepared by copolymerizing a maleimide, which being unsubstituted or substituted for a hydrogen atom of an imide group by an electron-donating group, and styrene or a styrene derivative, and the polymer block B is formed of a polymer of styrene or a styrene derivative.

The inventive toner-supplying cartridge is detachably mounted to image forming apparatuses, and supplies a toner to a toner-transporting members to transport the toner to image bearing members, and the toner comprises a binder resin, a colorant and a charge control agent; wherein the charge control agent comprises a copolymer that comprises a polymer block A and a polymer block B, the polymer block A is prepared by copolymerizing a maleimide, which being unsubstituted or substituted for a hydrogen atom of an imide group by an electron-donating group, and styrene or a styrene derivative, and the polymer block B is formed of a polymer of styrene or a styrene derivative.

The inventive process cartridge contains an image bearing member, a charging member to charge the image bearing member, a toner transporting member to transport a toner to the image bearing member, and a toner-supplying cartridge to supply the toner to the toner transporting member, and is detachably mounted to electrophotographic image forming apparatuses; the toner comprises a binder resin, a colorant and a charge control agent, the charge control agent comprises a copolymer that comprises a polymer block A and a polymer block B, the polymer block A is prepared by copolymerizing a maleimide, which being unsubstituted or substituted for a hydrogen atom of an imide group by an electron-donating group, and styrene or a styrene derivative, and the polymer block B is formed of a polymer of styrene or a styrene derivative.

The inventive image forming apparatus comprises an image bearing member, a charging member to charge the image bearing member, a toner transporting member to transport a toner to the image bearing member, a toner-supplying cartridge to contain a toner and supply the toner to the toner transporting member, a transfer member to transfer the toner image formed on the image bearing member to a transfer body, and a fixing member to fix the toner image transferred on the transfer body; the toner comprises a binder resin, a colorant and a charge control agent, the charge control agent comprises a copolymer that comprises a polymer block A and a polymer block B, the polymer block A is prepared by copolymerizing a maleimide, which being unsubstituted or substituted for a hydrogen atom of an imide group by an electron-donating group, and styrene or a styrene derivative, and the polymer block B is formed of a polymer of styrene or a styrene derivative.

The inventive image forming method comprises a latent image forming step of forming a latent image on an image bearing member, a toner image forming step of developing the latent image into a toner image by use of the inventive toner, a transfer step of transferring the developed toner image onto a transfer body, and a fixing step of fixing the toner image transferred onto the transfer body; the toner comprises a binder resin, a colorant and a charge control agent, the charge control agent comprises a copolymer that comprises a polymer block A and a polymer block B, the polymer block A is prepared by copolymerizing a maleimide, which being unsubstituted or substituted for a hydrogen atom of an imide group by an electron-donating group, and styrene or a styrene derivative, and the polymer block B is formed of a polymer of styrene or a styrene derivative.

In accordance with the present invention, a copolymer is provided that can be used for charge control agents suited to toners with excellent rating property of charging ability and superior stability of charge amount.

In accordance with the present invention, a charge control agent is provided that can be used for toners with excellent rating property of charging ability and superior stability of charge amount.

In accordance with the present invention, a toner is provided that can represent excellent rating property of charging ability and superior stability of charge amount.

In accordance with the present invention, a method is provided that can produce a toner with excellent rating property of charging ability and superior stability of charge amount.

In accordance with the present invention, a toner-supplying cartridge is provided that can contain toners with excellent rating property of charging ability and superior stability of charge amount and be utilized for image forming apparatuses.

In accordance with the present invention, a process cartridge is provided for image forming apparatuses that can exhibit excellent rising property of developing ability and superior stability.

In accordance with the present invention, an image forming apparatus is provided that can exhibit excellent rising property of developing ability and superior stability.

In accordance with the present invention, an image forming method is provided that can exhibit excellent rising property of developing ability and superior stability.

DETAILED DESCRIPTION OF THE INVENTION

Copolymer

Figure 1:
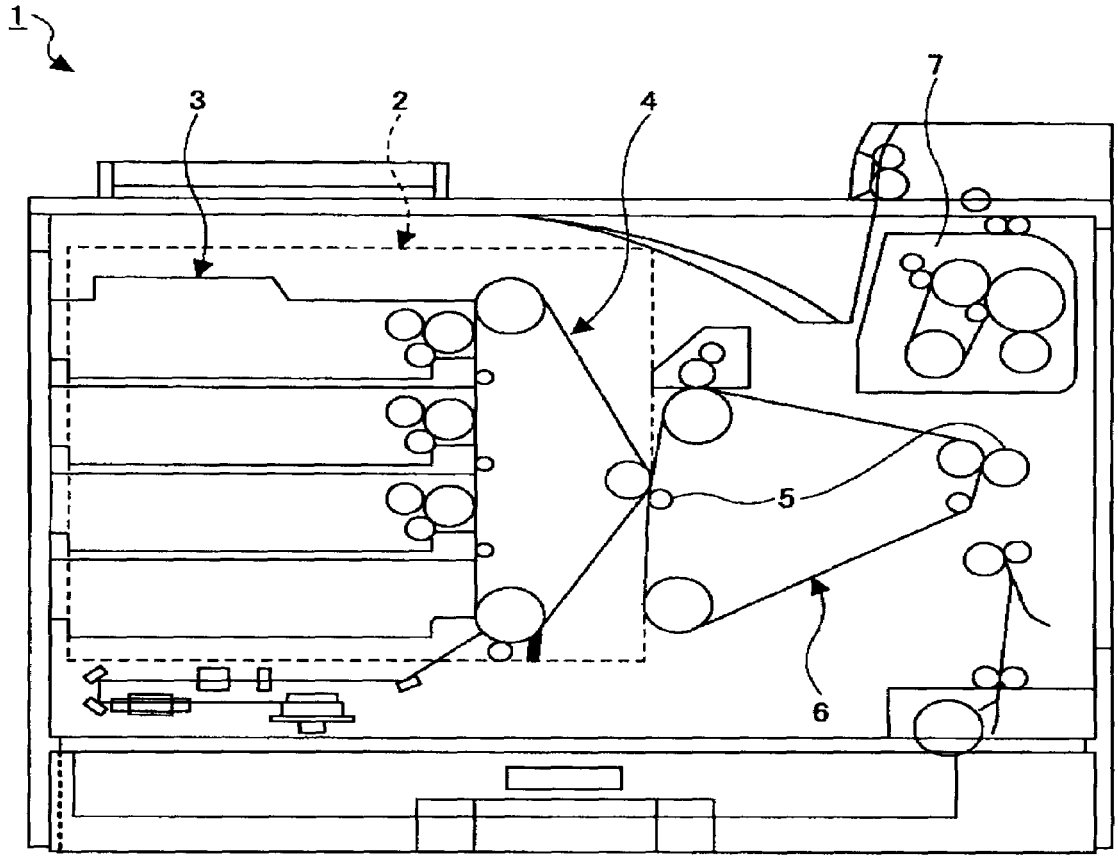
FIG. 1 shows a schematic configuration of an inventive image forming apparatus.

In an embodiment of the present invention, the copolymer contains a polymer block A and a polymer block B, in which the polymer block A is obtained by copolymerizing a maleimide, which being unsubstituted or substituted for a hydrogen atom of an imide group by a hydrocarbon group, and styrene or a styrene derivative, the polymer block B is a polymer of styrene or a styrene derivative. Preferably, the inventive copolymer contains an optional polymer block C other than the polymer blocks A and B.

The polymer blocks A, B and C of constitutional elements of the inventive copolymer will be explained in the following. The polymer block A is a copolymer block of an unsubstituted maleimide or a maleimide derivative in which a hydrogen atom of an imide group of maleimide is substituted by a hydrocarbon group or an electron-donating group (hereinafter "unsubstituted maleimide or a maleimide derivative in which a hydrogen atom of an imide group of maleimide is substituted by a hydrocarbon group or an electron-donating group" is sometimes generically referred to as "maleimide derivative (1)") and styrene or a styrene derivative (hereinafter "styrene or a styrene derivative" is sometimes generically referred to as "styrene derivative (1)"). It is preferred that the polymer block A is substantially an alternating copolymer or a random copolymer of a maleimide derivative (1) and a styrene derivative (1). When a monomer of maleimide derivative (1) and a monomer of styrene derivative (1) are mixed and allowed to react, ordinary polymerization reaction yields substantially an alternating copolymer, therefore, a preferable copolymer may be obtained by way of mixing a monomer of maleimide derivative (1) and a monomer of styrene derivative (1) and polymerizing the mixed monomers.

In the maleimide derivatives (1), a hydrogen atom of imide group of maleimide is unsubstituted or substituted by a hydrocarbon group or an electron-donating group. Specific examples of the hydrocarbon group are alkyl groups, alkenyl groups, cycloalkyl groups and aromatic groups; preferably, hydrocarbon groups having a carbon number of 22 or less is used. Examples of the alkyl groups include methyl group, ethyl group, propyl group, isopropyl group, butyl group, hexyl group, octyl group, 2-ethylhexyl group, dodecyl group, stearyl group and behenyl group. Examples of the cycloalkyl groups include cyclopentyl group and cyclohexyl group. Examples of the aromatic groups include phenyl group and naphthyl group. These substituents may be further substituted; examples thereof are phenyl group, naphthyl group, cyclopentyl group or cyclohexyl group substituted by methyl group, ethyl group, propyl group, isopropyl group, butyl group, hexyl group, octyl group, 2-ethylhexyl group, dodecyl group, stearyl group or behenyl group. Specific examples of the electron-donating group are oxygen-containing substituents and nitrogen-containing substituents besides the substituents described above as regard the hydrocarbon groups. Examples of the oxygen-containing substituents include hydroxy group, alkoxy groups such as methoxy group, ethoxy group and propoxy group; and phenoxy group. Examples of the nitrogen-containing substituents include amino groups, alkyl-substituted amino groups, cycloalkyl-substituted amino groups and phenyl-substituted amino groups. In addition, hydrocarbon groups such as alkyl groups, cycloalkyl groups and phenyl groups having a substituent with a hetero atom are allowable; examples thereof are phenyl group or alkyl groups having amino groups, hydroxy group or alkoxy groups. The hydrogen atom of imide group of the maleimide are not substituted by a substituent effective as an electron attractive group, for example, phenyl group substituted by an electron attractive group such as nitro group and halogen groups is impractical in the present invention.

The styrene derivative (1) typically indicates styrene and its derivatives that can undergo alternating copolymerization with the maleimide derivatives (1) while forming a charge transfer complex. The styrene derivatives are preferably ones of which 1 to 5, preferably 1 to 3 hydrogen atoms of benzene ring of styrene are substituted by substituents. When the styrene derivative is substituted by plural substituents, the substituents may be identical or different. The substituents are not defined particularly; specific substituents are exemplified, as regards hydrocarbon groups, by alkyl groups, alkenyl groups, cycloalkyl groups, aromatic groups, etc. Examples of the alkyl groups include methyl group, ethyl group, propyl group, isopropyl group, butyl group, hexyl group, octyl group, 2-ethylhexyl group, dodecyl group, stearyl group and behenyl group. Examples of the cycloalkyl groups include cyclopentyl group and cyclohexyl group. Examples of the aromatic groups include phenyl group and naphthyl group. These substituents may be additionally substituted; examples thereof are phenyl group, naphthyl group, cyclopentyl group or cyclohexyl group substituted by methyl group, ethyl group, propyl group, isopropyl group, butyl group, hexyl group, octyl group, 2-ethylhexyl group, dodecyl group, stearyl group or behenyl group. The substituents may be, in addition to the hydrocarbon groups, hetero atom-containing substituents such as oxygen-containing substituents, nitrogen-containing substituents and halogen-containing substituents. Examples of the oxygen-containing substituents include hydroxyl group, methoxy group, ethoxy group, propoxy group, phenoxy group, ether group, carboxyl group and carbonyl group. Examples of the nitrogen-containing substituents include amino groups, alkyl-substituted amino groups and phenyl-substituted amino groups. In addition, hydrocarbon groups such as alkyl groups, cycloalkyl groups and phenyl groups having an additional substituent are allowable; examples thereof are phenyl group or alkyl groups having amino groups, hydroxy group, alkoxy groups, nitro groups, sulfonyl groups or halogen groups.

Specific examples of the polymer block B are homopolymers of styrene and its derivatives capable of undergoing a homopolymerization and their copolymers. The styrene and its derivatives may be the styrene derivatives (1) described above. The styrene derivatives are preferably ones of which 1 to 5, preferably 1 to 3 hydrogen atoms of benzene ring of styrene are substituted by substituents. When the styrene derivative is substituted by plural substituents, the substituents may be identical or different. The substituents are not defined particularly; specific substituents as regards hydrocarbon groups are exemplified by alkyl groups, alkenyl groups, cycloalkyl groups, aromatic groups, etc. Examples of the alkyl groups include methyl group, ethyl group, propyl group, isopropyl group, butyl group, hexyl group, octyl group, 2-ethylhexyl group, dodecyl group, stearyl group and behenyl group. Examples of the cycloalkyl groups include cyclobutyl group, cyclopentyl group and cyclohexyl group. Examples of the aromatic groups include phenyl group and naphthyl group. These substituents may be additionally substituted; examples thereof are phenyl group, naphthyl group, cyclopentyl group or cyclohexyl group substituted by methyl group, ethyl group, propyl group, isopropyl group, butyl group, hexyl group, octyl group, 2-ethylhexyl group, dodecyl group, stearyl group or behenyl group. The substituents may be, in addition to the hydrocarbon groups, hetero atom-containing substituents such as oxygen-containing substituents, nitrogen-containing substituents and halogen-containing substituents. Examples of the oxygen-containing substituents include hydroxyl group, methoxy group, ethoxy group, propoxy group, phenoxy group, ether group, carboxyl group and carbonyl group. The nitrogen-containing substituents are exemplified by amino groups and alkyl-substituted amino groups. Examples of the halogen-containing substituents include chloro group, fluoro group, and fluoroalkyl groups such as trifluoromethyl group, pentafluoroethyl group, perfluoropropyl group, perfluoroisopropyl group and 1,1,1,3,3,3-hexafluoroisopropyl group. In addition, hydrocarbon groups such as alkyl groups, cycloalkyl groups and phenyl groups having an additional substituent are allowable; examples thereof are phenyl groups or alkyl groups having amino groups, hydroxy group, alkoxy groups, nitro groups, sulfonyl groups or halogen groups.

The polymer block C is one having an optional polymerization structure other than those of polymer blocks A and B. For example, when the polymer block C exists as an individual copolymer according to the present invention, the polymer block C may be the third polymer block other than the specific polymer blocks of polymer blocks A and B. In this case, the polymer block C may belong to the polymer block A or the polymer block B in view of definitions as long as being different from the polymer block A or the polymer block B of individual copolymer. For example, when the polymer block A is a styrene-phenyl maleimide polymer block and the polymer block is a styrene polymer block, the polymer block C may be a 4-methylstyrene polymer block that belong to the group of the polymer block B.

The polymer block C may be anything as long as the requirements described above are satisfied; preferably, the polymer block C is one that acts to enhance affinity with the binder resin when the inventive copolymer is utilized as a charge control agent of toner. Specific examples of the polymer block C are the polymer blocks formed of homopolymers or copolymers of polyesters, polyurethanes, polyureas, epoxy resins, or vinyl resins and the polymer blocks formed of these resins and the styrene derivatives (1). In addition, homopolymers or copolymers of styrene and its derivatives are allowable. The polymer block C may also be a homopolymer or a copolymer of styrene and its derivatives as long as different from the polymer blocks A and B in the inventive copolymer. That is, the styrene derivatives of this case may be the styrene derivatives (1) described above.

The polymer block C is preferably a copolymer of styrene or its derivatives. The monomer of the copolymer may be those of polyesters, polyurethanes, polyureas, epoxy resins, or vinyl resins that are utilized for a binder resin of toner. When the polymer block C is one that has the same monomer constituent as that of the resin used for the binder and is utilized as a charge control agent of toner, the affinity with the binder resin may be high, the dispersibility of the charge control agent may be adequate in the toner, and the structure of the charge control agent may be diversified.

The inventive copolymer may be anything as long as the polymer block A and the polymer block B exist in a polymer through a bond, and various structures are generally allowable such as block copolymer of polymer block A and polymer block B, block copolymer of polymer block A and polymer block C and block copolymer B, and graft polymer of polymer block C grafted with polymer block A and B. In addition, two or more of polymer block A, B or C may exist in a polymer.

The mechanism of the inventive copolymer is not necessarily clear as regards how to represent a specific effect to increase the charging ability as a charge control agent, but is believed as follows. In a case of a copolymer of the polymer block A and the polymer block B, for example, the polymer block A has a polymerizing unit of a maleimide derivative (1) that is a compound with an electron-acceptable skeleton, thus tends to charge negatively. Furthermore, the maleimide derivative (1) and the styrene derivative (1) form a charge transfer complex and easily yield a alternating copolymer; therefore, the electron trapped by the polymerizing unit of the maleimide derivative (1) in the copolymer can take a relatively stable condition between conjugated skeletons of polymerizing units of the styrene derivative (1), which further accelerates the negative charging. However, the effect to increase the charge amount is limited since the electron acceptable units are insufficient if provided from only the copolymer. When an electron-storable block of polystyrene derivative (polymer block B) exists near the polymer block A, a part of negative charge induced by the polymer block A transfers to the block of polystyrene derivative, thereby the saturated charge amount increases drastically. The negative charge is maintained, therefore, the saturated charge amount increases, and also the charging ability may be unchangeable and stable, thus stability of charge amount is improved under the actual use of toner and under the repeated usage of developing apparatuses. From these reasons, it is preferred that the polymer block A and the polymer block B exist at near sites; in particular, the highest effect may be attained when the polymer block A and the polymer block B connect through a covalent bond in a polymer.

Therefore, the use of the polymer block A in addition to the polymer block B that assumes the effect to increase the charge amount in resins can improve the rating property of charging ability. It is also believed that the existence of the polymer block A and the polymer block B as a copolymer makes easy to transfer the charge to the polymer block B, thus the saturated charge amount of the inventive charge control agent can be increased. The inventive charge control agent exhibits an excellent rating property of charging ability compared to charge control agents produced from copolymers of alkene derivatives other than styrene derivative (1) instead of the styrene derivative (1) of constitutional monomer of the polymer block A.

Copolymer Producing Method

The inventive copolymer producing method will be explained. Conventional copolymer producing methods can be made use of in the production of copolymer of the polymer blocks A and B as well as polymer blocks A, B and C. The method to produce the copolymer is exemplified by the method where blocks are produced sequentially though a living polymerization; the method to produce a graft polymer by way of readying preliminary a macro monomer having a block and copolymerizing when polymerizing another block; and the method to block-polymerize on the basis of monomer properties.

As regard the living polymerization, living anion polymerization, living cation polymerization, and living radical polymerization are generally employed; preferably, the living radical polymerization is employed in view of industrial and economical requirements. The living radical polymerization may be based on conventional methods, for example, a micro initiator having the first polymer block (e.g., polymer block A) is prepared by a polymerization reaction using a polymerization initiator such as 2,2,6,6-tetramethyl-1-pyperidinyloxy (TEMPO) and its derivatives, carbamate derivatives and organic tellurium compounds, then a monomer to form the unit of the second polymer block (e.g., polymer block B) is introduced into the reactant to cause a polymerization reaction thereby a block copolymer may be obtained.

In the method to produce a graft polymer by use of macro monomer, for example, a commercially available macro monomer is used. Alternatively, a macro monomer is prepared by polymerizing a polymer with a reactive end using a chain transfer agent of addition cleavage type such as alpha-methylstyrene dimer. The macro monomer and the monomer to form the principal chain of the graft polymer are subjected to a polymerization reaction thereby to produce a graft polymer.

The method to block-polymerize on the basis of monomer properties may lead to the inventive charge control agent in a way that when the raw material of monomer mixture tends to alternatively copolymerize like the styrene derivative (1) and the maleimide derivative (1), the mole ratio of the styrene derivative (1) and the maleimide derivative (1) is appropriately adjusted such as the styrene derivative (1) exists excessively. For example, "Polymer Handbook 4th Edition II, 257-258" describes that the reactivity ratio of monomers is r(styrene)=0.057, r(maleimide)=0.088 in copolymerization of styrene and maleimide, r(styrene)=0.016 to 0.07, r(N-phenylmaleimide)=0.01 to 0.044 in copolymerization of styrene and maleimide, and also the reaction velocity is higher than the individual polymerization, therefore, when the mole amount of styrene is more than that of the maleimide derivative (1), the alternating copolymerization of the styrene and the maleimide derivative (1) occurs preferentially at the initial reaction stage, resulting in the inventive polymer block A. Thus the styrene and the maleimide derivative (1) are consumed by an equivalent mole amount; then only the remaining styrene polymerizes successively after the maleimide derivative (1) is depleted, resulting in the inventive polymer block B. In this case, the resulting polymer is a block copolymer that contains an alternating copolymer block of styrene and maleimide derivative (1) and a polymer block consisting of only styrene. The block copolymer may exert a sufficient effect as the inventive charge control agent. This polymerization process is preferable for the present invention since special compounds are unnecessary for the polymerization and the process is inexpensive. The mole ratio of the styrene derivative (1) to the maleimide derivative (1) is preferably within a range of 1.5:1 to 10:1. In this polymerization process, the constitutional ratio of the polymer block A and the polymer block B is adjusted by changing the mole ratio of the styrene derivative (1) to the maleimide derivative (1).

Charge Control Agent

The inventive charge control agent may be anything as long as capable of controlling the charging ability of resins or compositions containing a resin and contains the inventive copolymer described above. The inventive charge control agent may exert the inventive effect without diminishing the effect in no way, as long as containing the inventive copolymer, even though containing polymers, other than the inventive copolymer, such as polyesters, polyurethanes, polyureas, epoxy resins, vinyl resins, or polymers of only polymer block A or B. The inventive charge control agent may be incorporated with resins to enhance the binding ability with binder resins or additives to improve stability as the charge control agent in the processes to employ as the toner material as described above.

Toner

The toner, which may be an electrostatic image developing toner, that contains the inventive charge control agent will be explained in the following. The inventive toner contains at least the inventive charge control agent, a colorant, and a binder resin. In addition, the inventive toner may optionally contain conventional additives such as charge control agents, wax ingredients and external additives. The amount of the charge control agent in the inventive toner depends on the species of colorants and binder resins, optional various additives, and toner production processes like dispersion processes, and is not defined particularly; preferably, the amount of the charge control agent is 1 to 20 parts by mass based on 100 parts by mass of the toner, particularly preferably 1.5 to 15 parts by mass. The amount of the charge control agent of less than 1 part by mass is impractical due to insufficient negative charge of toner; and the amount of the charge control agent of above 20 parts by mass leads to excessively high charging ability of toner and excessively intense electrostatic absorbing strength with carrier, thus resulting in low flowability of developer or low image density.

Colorant

The colorant may be properly selected from conventional dyes and pigments; examples thereof include carbon black, nigrosine dyes, iron black, Naphthol Yellow S, Hansa Yellow (10G, 5G, G), cadmium yellow, yellow iron oxide, yellow ocher, chrome yellow, Titan Yellow, Polyazo Yellow, Oil Yellow, Hansa Yellow (GR, A, RN, R), Pigment Yellow L, Benzidine Yellow (G, GR), Permanent Yellow (NCG), Vulcan Fast Yellow (5G, R), Tartrazine Lake, Quinoline Yellow Lake, anthracene yellow BGL, isoindolinone yellow, colcothar, red lead oxide, lead red, cadmium red, cadmium mercury red, antimony red, Permanent Red 4R, Para Red, Fire Red, parachlororthonitroaniline red, Lithol Fast Scarlet G, Brilliant Fast Scarlet, Brilliant Carmine BS, Permanent Red (F2R, F4R, FRL, FRLL, F4RH), Fast Scarlet VD, Vulcan Fast Rubine B, Brilliant Scarlet G, Lithol Rubine GX, Permanent Red F5R, Brilliant Carmine 6B, Pigment Scarlet 3B, Bordeaux 5B, Toluidine Maroon, Permanent Bordeaux F2K, Helio Bordeaux BL, Bordeaux 10B, BON Maroon Light, BON Maroon Medium, eosine lake, Rhodamine Lake B, Rhodamine Lake Y, Alizarine Lake, Thioindigo Red B, Thioindigo Maroon, Oil Red, quinacridone red, Pyrazolone Red, Polyazo Red, Chrome Vermilion, Benzidine Orange, Perynone Orange, Oil Orange, cobalt blue, cerulean blue, Alkali Blue Lake, Peacock Blue Lake, Victoria Blue Lake, metal-free phthalocyanine blue, Phthalocyanine Blue, Fast Sky Blue, Indanthrene Blue (RS, BC), indigo, ultramarine, Prussian blue, Anthraquinone Blue, Fast Violet B, Methyl Violet Lake, cobalt violet, manganese violet, dioxazine violet, Anthraquinone Violet, chrome green, zinc green, chromium oxide, viridian, emerald green, Pigment Green B, Naphthol Green B, Green Gold, Acid Green Lake, Malachite Green Lake, Phthalocyanine Green, Anthraquinone Green, titanium oxide, zinc white, lithopone and combinations thereof.

The amount of the colorant is preferably 1 to 15% by mass based on the toner, more preferably 3 to 10% by mass.

The colorant in the present invention may be combined with a resin for binder resin and used in a form of masterbatch. The resin to prepare the master batch may be, in addition to conventional modified or unmodified polyester resins, polymers of styrene or its derivatives such as polystyrene, poly-p-chlorostyrene and polyvinyltoluene; styrene copolymers such as styrene/p-chlorostyrene copolymer, styrene-propylene copolymer, styrene-vinyltoluene copolymer, styrene-vinylnaphthalene copolymer, styrene-methylacrylate copolymer, styrene-ethylacrylate copolymer, styrene-butylacrylate copolymer, styrene-octylacrylate copolymer, methylmethacrylate copolymer, styrene-ethylmethacrylate copolymer, styrene-butylmethacrylate copolymer, styrene-alpha-chloromethylmethacrylate copolymer, styrene-acrylonitrile copolymer, styrene-vinylmethylketone copolymer, styrene-butadiene copolymer, styrene-isoprene copolymer, styrene-acrylonitrile-indene copolymer, styrene-maleic acid copolymer and styrene-maleic acid ester copolymer; polymethylmethacrylate, polybutylmethacrylate, polyvinylchloride, polyvinyl acetate, polyethylene, polypropylene, polyester, epoxy resins, epoxy polyol resins, polyurethane, polyamide, polyvinylbutyral, polyacrylic acid resins, rosin, modified rosin, terpene resins, aliphatic or cycloaliphatic hydrocarbon resins, aromatic petroleum resins, chlorinated paraffin and paraffin wax; these may be used alone or in combination.

The process to produce the master match may be properly selected; for example, a resin and a colorant for the master batch are mixed and kneaded under a high shear force. An organic solvent may be used in the method in order to enhance the interaction between the colorant and the resin. Such a so-called flushing process may also be available, in which an aqueous paste containing the colorant and water is mixed and kneaded with a resin and an organic solvent, the colorant is transferred toward the resin, and the water and the organic solvent are removed. The process is an appropriate process for producing the master batch since the wet cake of the colorant can be directly used without drying. The mixing and kneading is preferably carried out using high-shear dispersing devices such as three rolls.

Other Additives

In the inventive toner, conventional charge control agents may be use together with in order to optimize the charge amount of toner, for example. The conventional charge control agents are exemplified by nigrosine dye, triphenylmethane dye, chromium-containing metal complex dye, molybdic acid chelate pigment, rhodamine dye, alkoxy amine, quaternary ammonium salt such as fluoride-modified quaternary ammonium salt, alkylamide, elemental phosphorus or compound thereof, elemental tungsten or compound thereof, fluoride activator, metallic salts of salicylic acid, and metallic salts of salicylic acid derivatives. Specifically, Bontron 03 of nigrosine dye, Bontron P-51 of quaternary ammonium salt, Bontron S-34 of metal-containing azo dye, Bontron E-82 of oxynaphthoic acid metal complex, Bontron E-84 of salicylic acid metal complex, and Bontron E-89 of phenol condensate (by Orient Chemical Industries, Ltd.); TP-302 and TP-415 of quaternary ammonium salt molybdenum metal complex (by Hodogaya Chemical Co.); Copy Charge PSY VP2038 of quaternary ammonium salt, Copy Blue PR of triphenylmethane derivative, and Copy Charge NEG VP2036 and Copy Charge NX VP434 of quaternary ammonium salt (by Hoechst Ltd.); LRA-901, and LR-147 of boron metal complex (by Japan Carlit Co., Ltd.), copper phthalocyanine, perylene, quinacridone, azo pigment, and other high-molecular weight compounds having a functional group, such as sulfonic acid group, carboxyl group, and quaternary ammonium salt.

The inventive toner may contain a wax that acts as a release agent. The wax may be selected from conventional ones; examples thereof include polyolefin waxes such as polyethylene waxes and polypropylene waxes; long-chain hydrocarbons such as paraffin waxes and sazol waxes; and carbonyl group-containing waxes. Examples of the carbonyl group-containing waxes include polyalkanoic acid esters such as carnauba waxes, montan waxes, trimethylolpropane tribehenate, pentaerythritol tetrabehenate, pentaerythritol diacetate dibehenate, glycerin behenate, and 1,18-octadecandiol distearate; polyalkanol esters such as tristearyl trimellitate, and distearyl maleate; polyalkanoicamides such as ethylene diamine dibehenylamides; polyalkylamides such as tristearylamide trimellitate; and dialkylketones such as distearylketone. Among these carbonyl group-containing waxes, the polyalkanoic acid esters may be appropriately used. In addition, waxes of lower polarity are preferable for the present invention; preferable examples are hydrocarbon waxes such as polyethylene wax, polypropylene wax, paraffin wax, sazole wax, microcrystalline wax and Fisher-Tropsch wax.

It is preferable in the present invention that the amount of the wax in the toner is 3 to 15 parts based on 100 parts by mass of the toner, more preferably 4 to 12 parts by mass, still more preferably 5 to parts by mass. When the amount of the wax is less than 3 parts by mass based on 100 parts of the toner, the releasing effect of wax is unclear, and the allowance to prevent offset may be insufficient. On the other hand, when the amount is above 15 parts by mass, the toner tends to be influenced by thermal or mechanical energy since the toner melts at lower temperatures, the wax often bleeds from inside toner when stirring at developing processes and deposits on toner-control members or photoconductors, resulting in image noises. Furthermore, when printed on OHP sheets, the release agent often spreads beyond printing regions, causing image noises on projected images.

It is preferred that an endothermic peak of wax appears during the temperature-rising step within a range of 60° C. to 90° C., more preferably 65° C. to 80° C. measured by a differential scanning calorimeter (DSC). The endothermic peak of below 60° C. tends to degrade the flowability and storage stability, and the peak above 90° C. tends to degrade fixability. It is also preferable that the half-value width of the endothermic peak during the temperature-rising step measured by the differential scanning calorimeter is preferably 8° C. or less, more preferably 6° C. or less. When the half-value width of the endothermic peak is broad such as above 8° C., the flowability and storage stability may be inferior.

In order to auxiliarily improve the flowability, developing ability and charging ability of the inventive toner, an external additive may be employed. The external additive may be conventional ones, for example, selected from inorganic fine particles and polymer fine particles. Preferably, the inorganic fine particles have a primary particle diameter of 5 nm to 2 μm, more preferably 5 to 500 nm. The specific surface area of the inorganic fine particles by BET method is preferably 20 to 500 $m^2/g$. The amount of the inorganic fine particles in the toner is preferably 0.01 to 5 parts by mass, more preferably 0.01 to 2.0 parts by mass. Specific examples of inorganic fine particles include silica, alumina, titanium oxide, barium titanate, magnesium titanate, calcium titanate, strontium titanate, zinc oxide, tin oxide, quartz sand, clay, mica, silicic pyroclastic rock, diatomaceous earth, chromic oxide, cerium oxide, iron oxide red, antimony trioxide, magnesium oxide, zirconium oxide, barium sulfate, barium carbonate, calcium carbonate, silicon carbide, silicon nitride, and the like. The polymer fine particles are exemplified by various polymer particles of polystyrene, copolymers of methacrylic acid ester or acrylic acid ester, polycondensation resins and thermosetting resins such as silicone, benzoguanamine and nylon.

The external additive may be prevented from its deterioration of flowability or charging ability even under high humidity conditions by improving the hydrophobicity thereof using a surface treatment agent. Preferable examples of the surface treatment agent include silane coupling agents, sililation reagents, silane coupling agents having a fluorinated alkyl group, organic titanate coupling agents, aluminum coupling agents, silicone oils and modified silicone oils.

In order to remove unnecessary toners remaining after transferring on photoconductors or primary transfer media of image forming apparatuses, the inventive toner may contain a cleaning aid. The cleaning aid is exemplified by fatty acid metal slats such as zinc stearate, calcium stearate, and stearic acid; and polymer fine particles produced by a soap-free emulsion polymerization such as polymethyl methacrylate fine particles and polystyrene fine particles. Polymer fine particles preferably have a relatively narrow particle size distribution and a mass average particle diameter of 0.01 to 1 μm.

Toner Producing Method

The toner producing method according to the present invention may be on the basis of wet processes such as dissolving-suspending processes, suspension polymerization processes and emulsion-agglomeration processes; and milling processes, but not limited to.

Dissolving-Suspending Process

In a case of the dissolving-suspending process to produce the inventive toner, for example, at least a binder resin, a colorant and the inventive charge control agent are dissolved into an organic solvent to dissolve or disperse them thereby to prepare a solution or a dispersion, which is then dispersed into water or an aqueous dispersion medium using an ordinary stirrer, homomixer or homogenizer to attain an intended particle distribution, then the organic solvent is removed to prepare a toner slurry. Preferably, an organic dispersant or resin fine particles are added to the aqueous solvent. The toner slurry is filtered, rinsed and dried by conventional processes thereby to produce a toner.

Examples of the organic solvent include toluene, xylene, benzene, carbon tetrachloride, methylene chloride, 1,2-dichloroethane, 1,1,2-trichloroethane, trichloroethylene, chloroform, monochlorobenzene, dichloroethylidene, methylacetate, ethylacetate, methylethylketone and methylisobutylketone; these solvents may be used alone or in combination. It is preferred that the organic solvent has a boiling point lower than that of the aqueous solvent typically below 100° C. so as to be removed from the aqueous solvent easily.

The aqueous solvent may be water itself or a water-miscible solvent may be used together with. Examples of the water-miscible solvent include alcohols such as methanol, isopropanol and ethylene glycol, dimethylformamide, tetrahydrofuran, cellosolves such as methyl cellosolve; lower ketones such as acetone and methyl ethyl ketone. The amount of the aqueous solvent is typically 50 to 2000 parts by mass based on 100 parts mass of the toner ingredients; preferably 100 to 1000 parts by mass. When the amount is less than 50 parts by mass, the toner ingredients tend to lack dispersibility. The amount above 2000 parts by mass may be technically allowable, but far from economical due to heavy processes in dispersion or separation.

The inorganic dispersant may be conventional ones such as tricalcium phosphate, magnesium phosphate, aluminum phosphate, zinc phosphate, magnesium carbonate, calcium hydroxide, magnesium hydroxide, aluminum hydroxide, calcium metasilicate, calcium sulfate, barium sulfate, bentonite, alumina, calcium carbonate, titanium oxide, colloidal silica and hydroxyl apatite.

The resin to form the resin fine particles is not limited particularly as long as capable of forming a dispersion in aqueous solvents; examples thereof include vinyl resins, polyurethane resins, epoxy resins, polyester resins, polyamide resins, polyimide resins, silicon resin, phenol resins, melamine resins, urea resins, aniline resins, ionomer resins and polycarbonate resins. These resins may be thermoplastic or thermosetting resins, and may be used in combination. Among these, polyurethane resins, epoxy resins, polyester resins and combination thereof are preferable since fine spherical resin particles are easily obtainable. The resin fine particles may be produced by way of adding a prepolymer such as polyester into an aqueous solvent to react the prepolymer to polycondensate in a toner producing step, in addition to pouring and dispersing into an aqueous solvent.

Emulsion-Agglomeration Process

In a toner producing method by an emulsion-agglomeration process, at least an inventive charge control agent is dissolved or dispersed into a monomer of binder raw material, which is then added to an aqueous solvent and emulsified using an emulsifier, to which then a resin dispersion containing an inventive charge control agent prepared by polymerizing the monomer using a polymerization initiator is agglomerated and melted-attached along with dispersion of colorant and wax thereby to prepare a toner slurry. The toner slurry is filtered, rinsed and dried by conventional processes thereby to produce the inventive toner.

The monomer described above may be various vinyl monomers, more specifically, styrene and its derivatives such as styrene, p-methylstyrene, p-styrene sulfonic acid, p-chlorostyrene, p-carboxystyrene, alpha-methylstyrene and divinylstyrene, vinylesters such as vinylnaphthalene, vinylchloride, vinyl bromide, vinyl fluoride, vinyl acetate, vinyl propionate, vinyl benzoate and vinyl butyrate, (meth)acrylic acid and esters thereof such as (meth)acrylic acid, methyl (meth)acrylate, ethyl(meth)acrylate, propyl(meth)acrylate, isopropyl(meth)acrylate, butyl(meth)acrylate, t-butyl(meth) acrylate, hexyl(meth)acrylate, octyl(meth)acrylate, 2-ethylhexyl(meth)acrylate, decyl(meth)acrylate, dodecyl(meth) acrylate, stearyl(meth)acrylate, behenyl(meth)acrylate, 1,6-hexanediol diacrylate and 1,10-decandiol diacrylate; (meth) acrylamides such as N-N-dimethyl(meth)acrylamide, N-N-diethyl(meth) acrylamide and N-N-dibutyl(meth) acrylamide; maleic acid, maleic anhydride, maleic acid mono-ester, maleic acid diester, itaconic acid and its esters, and other various vinyl esters.

The emulsifier may be conventional ones; examples thereof include anionic emulsifiers such as sodium alkylsulfate, sodium alkylbenzenesulfate, sodium polyoxyethylene alkylethersulfate, sodium alkylnaphthalenesulfate, sodium dialkylsulfosuccinate, sodium alkyldiphenyletherdisulfonate, nonionic emulsifiers such as polyoxyethylene alkylether, polyoxyethylene alkenylether, polyoxypropylalkylether and sorbitane fatty acid ester; cationic emulsifiers such as alkyltrimethylammonium chloride and dialkyl dimethylammonium chloride; and amphoteric emulsifiers such as alkyl betaine. Among these, anionic emulsifiers are excellently stable in emulsifying and thus favorably employed. When reactive emulsifiers having both of a hydrophilic group and a polymerizable group are employed, a dispersion may be polymerized and stabilized for the dispersed condition.

The polymerization initiator may be conventional ones; examples thereof include water-soluble polymerization initiators such as ammonium persulfate, potassium persulfate, sodium persulfate, hydrogen peroxide, 4,4'-azobis(4-cyanovaleic acid) and its salts, and 2-2'-azobis(2-aminodipropane) salts; azo or diazo polymerization initiators such as 2-2'-azobis(2,4-dimethylvaleronitrile), 2-2'-azobis(isobutylonitrile), 1-1'-azobis(cyclohexane-1-carbonitrile), 2-2'-azobis(4-methoxy-2,4-dimethylvaleronitrile) and azobis(isobutylonitrile); oil-soluble polymerization initiators such as benzoyl peroxide, methylethylketone peroxide, diisopropyl peroxycarbonate, cumene hydroperoxide, 2,4-dichlorobenzoyl peroxide and lauryloyl peroxide.

Suspension Polymerization Process

When a toner is produced by suspension polymerization processes, an inventive charge control agent, a colorant, a polymerization initiator, and other optional additives are added into a monomer of raw material of a binder resin, the mixture is dissolved or dispersed uniformly by use of a homogenizer, a ultrasonic dispersing device etc. to prepare a solution or a dispersion, which is then subjected to monomer-polymerize within an aqueous solvent containing a dispersion stabilizer while dispersing the solution or the dispersion using an ordinary stirrer, homomixer or homogenizer. It is preferred that the stirring velocity and period are adjusted then to produce particles so that the liquid droplets of monomer have an intended particle diameter corresponding to the desirable toner. Thereafter, the particle condition may be maintained by action of the dispersion stabilizer and the dispersion is stirred to prevent sedimentation. The polymerization temperature is usually 40° C. or higher, preferably 50° C. to 90° C. The reactant may be heated at the later stage of the polymerization reaction. The aqueous solvent may be distilled away at the later stage of or after the polymerization reaction in order to remove unreacted monomers that cause odor at fixing toners. After the polymerization reaction, the resulting toner is collected by washing and filtering processes and dried.

Examples of the dispersion stabilizer includes inorganic compounds such as tricalcium phosphate, magnesium phosphate, aluminum phosphate, zinc phosphate, calcium carbonate, magnesium carbonate, calcium hydroxide, magnesium hydroxide, aluminum hydroxide, calcium metasilicate, calcium sulfate, barium sulfate, bentonite, silica and alumina; organic compounds such as polyvinyl alcohol, gelatin, methylcellulose, methylhydroxypropylcellulose, ethylcellulose, sodium salt of carboxymethylcellulose, polyacrylic acid and its salts and starch. The dispersion stabilizer may be used as a dispersion in aqueous solvents. The amount of the dispersion stabilizer is preferably 0.2 to 20% by mass based on the monomer. The dispersion stabilizer may be commercially available inorganic compounds without modification; alternatively, inorganic compounds may be synthesized in a dispersive medium in order to obtain fine particles. For example, when an aqueous solution of sodium phosphate and an aqueous solution of calcium chloride are stirred under a high speed stirring, fine particles of tricalcium phosphate can be obtained.

Milling Process

When a toner is produced on the basis of milling or crushing processes, the production process contains a step of mixing mechanically at least the inventive charge control agent, a binder resin and a colorant, a step of melting-kneading the mechanically mixed mixture, a step of milling the melted-kneaded product, and a step of classifying the milled product. An off-specification product may be recycled into the mechanically mixing step or the melting-kneading step.

The step of mechanically mixing the inventive charge control agent, the binder resin and the colorant is not limited particularly, and may be carried out using mixers etc. with stirring blades under usual conditions. The mixture is melted-kneaded in a kneader after the mechanical mixing. The melting kneader may be mono-axis or two-axis continuous kneaders or batch kneaders like roll mills; preferable examples thereof include KTK type two-axis extruder (by Kobe Steel, Ltd.), TEM type two-axis extruder (by Toshiba Machine Co.), two-axis extruder (by KCK Co.), PCM type two-axis extruder (by Ikegai Ltd.), and Co-kneader (by Buss Co.). It is preferred that the melting-kneading step is carried out under appropriate conditions far from cutoff of molecular chains in binder resins. Preferably, the melting-kneading temperature is adjusted referring to the softening point of the binder resin; when the temperature is excessively lower than the softening point, the cutoff will be significant, and excessively high temperature results in poor dispersion.

The kneaded product is milled after the step of melting-kneading. Preferably, the material is roughly milled then finely milled in the milling step. Preferable milling processes are exemplified by making the materials collide with a plate by means of jet air, making particles collide each other by means of jet air, or pulverizing by use of a narrow gap between mechanically rotating rotors and stators. After the milling step, the milled product is classified in an air flow by use of centrifugal force, thereby to produce a developer having a predetermined particle diameter.External Treatment The inventive toner, produced as described above, may be incorporated with an external additive thereby to stabilize the charging ability or the flowability to provide a highly commercial toner. For example, the inventive toner is mixed with an external additive along with fine particles of charge control agent or fluidizer to produce a mixed powder. Preferably, toner particles are bonded-fused at surfaces of different species of particles by applying a mechanical impulse to the mixed powder. Specific processes are exemplified by processes where an impact force is applied to the mixture by rotating blades in high speed, and processes where a mixture is poured into a high-speed flow and accelerated to collide onto an appropriate collision board. Examples of the apparatuses or devices to bond and fuse are angmills (by Hosokawa Micron Co.), 1-type mills modified to reduce milling air pressure (by Nippon Pneumatic MFG., Co.), hybridization systems (by Nara Machine Corporation), Kryptron Systems (by Kawasaki Heavy Industries, Ltd.), and automatic mortars.

Toner-Supplying Cartridge

Figure 2:
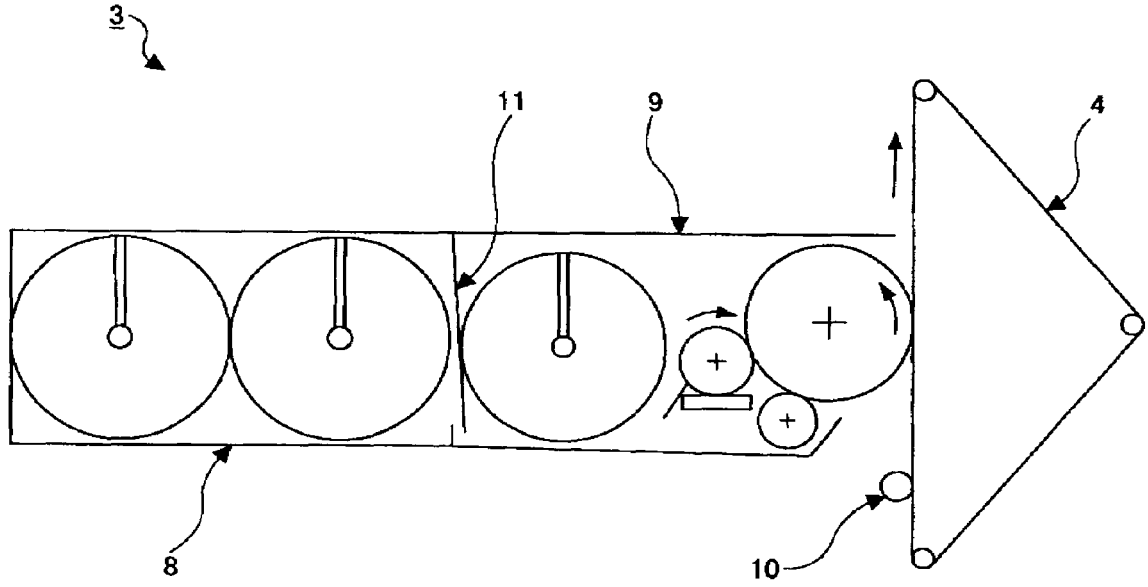
FIG. 2 shows a schematic configuration of a developing unit of an inventive image forming apparatus.

The inventive toner-supplying cartridge is detachably mounted to electrophotographic developing apparatuses that contains at least a rotatable image bearing member, a charging member that is disposed with the image bearing member and charges the image bearing member into a pre-determined voltage, a toner transporting member that rotates in contact or near the photoconductor to transport a toner to the image bearing member, and a toner-supplying cartridge that contains a toner and supply the toner to the toner transporting member; the toner-supplying cartridge contains the inventive toner described above and can supply the inventive toner to the toner transporting member. The image forming apparatus 1 shown in FIG. 1 is constructed from an image bearing member 4, a developing device 3 that contains a charging member, a toner-transporting member and a toner-supplying member, a transfer member 5 and a fixing member, etc. FIG. 2 shows a schematic construction of the inventive developing device 2 that is a part of the image forming apparatus 1 shown in FIG. 1. In FIG. 2, the developing device 3 contains an image bearing member 4, a charging member 10, a toner transporting member 9, a toner-supplying member 8 and a partition plate 11. The inventive toner, contained in the toner supplying cartridge 8, is transported through the toner transporting member 9 of the developing device 3 on to the image bearing member and used to form a toner image. The inventive toner supplying cartridge 8 can be appropriately used for electrophotographic image forming apparatuses, since the inventive toner can be use in an adequate amount for developing apparatuses due to larger level to be charged and represents appropriate rating property of charging ability.

Process Cartridge

The inventive process cartridge is detachably mounted to electrophotographic image forming apparatuses, and contains at least a rotatable image bearing member, a charging member that is disposed with the image bearing member and charges the image bearing member into a pre-determined voltage, a toner transporting member that rotates in contact or near the photoconductor to transport a toner to the image bearing member, and a toner-supplying cartridge that contains the inventive toner and supply the toner to the toner transporting member. In general, the inventive process cartridge is integrally constructed from at least two or more of the photoconductor, the charging unit, the developing unit, and the cleaning unit; and the process cartridge is detachably disposed on a main body of image forming apparatuses such as copiers and printers. The process cartridge 2 of the image forming apparatus 1 shown in FIG. 1 comprises the developing device 3 that contains an image bearing member 4, a charging member, a toner transporting member and a toner-supplying member. The inventive process cartridge can be appropriately used for electrophotographic image forming apparatuses, since the inventive toner can be use in an adequate amount for developing apparatuses due to larger level to be charged and represents appropriate rating property of charging ability.

Image Forming Apparatus

The inventive image forming apparatus comprises, as shown in FIGS. 1 and 2, contains at least a rotatable image bearing member 4, a charging member 10 that is disposed with the image bearing member and charges the image bearing member into a pre-determined voltage, a toner transporting member 9 that rotates in contact with or near the photoconductor to transport a toner to the image bearing member, a toner-supplying cartridge that contains a toner and supply the toner to the toner transporting member; a transfer member 5 to transfer the toner image formed on the image bearing member to a transfer body, and a fixing member 7 to fix the toner image transferred on the transfer body. The image forming apparatus shown in FIG. 1 is equipped with an intermediate transfer body 6. The inventive image forming apparatus can be appropriately used, since the inventive toner can be use in an adequate amount for developing apparatuses due to larger level to be charged and represents appropriate rating property of charging ability.

Image Forming Method

The inventive image forming method comprises a latent image forming step of forming a latent image on an image bearing member, a toner image forming step of developing the latent image into a toner image by use of the inventive toner, a transfer step of transferring the developed toner image onto a transfer body, and a fixing step of fixing the toner image transferred onto the transfer body. The inventive image forming method will be explained specifically as regards the performance of the inventive image forming apparatus and the process cartridge with reference to FIG. 1. In the image forming apparatus 1 shown in FIG. 1, a photoconductor of an image bearing member 4 is rotated at a predetermined circumferential velocity, the photoconductor is uniformly charged to a predetermined positive or negative potential over the circumferential face by a charging member, then is irradiated by an image exposing light from an image exposure unit such as slit irradiation and laser beam scanning exposure, thereby electrostatic latent images are formed on the circumferential face of the photoconductor in order. The resulting electrostatic latent image is developed into a toner image by use of the inventive toner supplied from the toner-supplying cartridge 8. The above descriptions explain the performance of the process cartridge 2. Then the developed images are transferred to the transfer material by the transfer member 5 sequentially, in which the transfer material is synchronized with the rotation of the photoconductor and supplied from a paper supplying portion between the photoconductor and the transfer member 5. The transfer member, to which an image has been transferred, is separated from the face of the photoconductor, and introduced into the fixing member 7 and the image is fixed; the image-fixed transfer material is printed out as a copy or a print. The surface of the image-transferred photoconductor is cleaned as regards the remaining toner by a cleaning unit and discharged, followed by forming images repeatedly.

Toner Analyzing Process

Toners etc. were analyzed and evaluated as follows. The evaluation was carried out with respect to one-component developer; the inventive toner may be used as a two-component developer through an appropriate external treatment and a combination with an adequate carrier.

Particle Diameter of Toner

The particle size distribution of toner particles was measured in accordance with Coulter counter process. Coulter Counter TA-II and Coulter Multisizer II (by Beckman Coulter, Inc.) were used for the measuring apparatuses. The specific measuring process is as follows. Initially, 0.1 to 5 mL of a surfactant of alkylbenzene sulfonate is added as a dispersant into 100 to 150 mL of an aqueous electrolyte solution. The aqueous electrolyte solution is an about 0.1% NaCl aqueous solution, which is prepared from ISOTON-II (by Beckman Coulter, Inc.). A sample of 2 to 20 mg was added to the electrolyte solution, which was then ultrasonically dispersed for 1 to 3 minutes using a ultrasonic dispersing device, thereafter volume and number of the toner particles are measured by the Coulter counter TA-II using an aperture of 100 μm to calculate the volume distribution and the number distribution, from which the volume average particle diameter and the number average particle diameter are determined. In order to measure particles having a particle diameter (Pd) of no less than 2.00 μm to less than 40.30 μm, thirteen channels are used such as 2.00 μm≦Pd<2.52 μm, 2.52 μm≦Pd<3.17 μm, 3.17 μm≦Pd<4.00 μm, 4.00 μm≦Pd<5.04 μm, 5.04 μm≦Pd<6.35 μm, 6.35 μm≦Pd<8.00 μm, 8.00 μm≦Pd<10.08 μm, 10.08 g/m≦Pd<12.70 μm, 12.70 g/m≦Pd<16.00 g/m, 16.00 μm≦Pd<20.20 μm, 20.20 μm≦Pd<25.40 μm, 25.40 μm≦Pd<32.00 μm and 32.00 μm≦Pd<40.30 μm.

Particle Diameter of Fine Particles

The particle diameter of inorganic fine particles and vinyl copolymer resin fine particles can be determined by use of measuring equipments such as LA-920 (by HORIBA, Ltd.) and UPA-EX150 (by NIKKISO Co.) in a condition of dispersions themselves.

Molecular Mass

The molecular mass of the polyester resins and vinyl copolymer resins was determined by usual gel permeation chromatography.

apparatus: HLC-8220GPC (by Tosoh Co.)
column: TSK gel Super HZM-Mx3
temperature: 40° C.
solvent: THF (tetrahydrofuran)
flow rate: 0.35 mL/min
sample: concentration 0.05 to 0.6% by mass, amount 0.01 mL From the molecular mass distribution measured under the conditions described above, mass average molecular mass Mw was calculated using a calibration curve formed from monodispersion polystyrene standards. The monodispersion polystyrene standards were 10 samples of $5.8\times10^2$ to $7.5\times10^6$.

EXAMPLES

The present invention will be explained more specifically with reference to Examples. In the descriptions below, all of "part" are expressed by "part by mass" unless indicated otherwise.

Synthesis of Charge Control Agent

Synthesis of Charge Control Agent (1)

One hundred and twenty parts of methylethylketone was poured into a reactor vessel equipped with a stirring blade, a reflux tube and a thermometer, and was heated under nitrogen gas atmosphere. From the stage that the methylethylketone began to boil and reflux, the monomer mixture (1) shown below was introduced dropwise over 2 hours (referred to as "first drop").

| Monomer mixture (1) | |
|---|---|
| styrene | 20.8 parts |
| N-phenyl maleimide | 34.6 parts |
| methylethylketone | 80.0 parts |
| t-butyl peroxyoctate | 10.8 parts |

After the first drop was completed, 26.0 parts of styrene was introduced dropwise over 30 minutes (referred to as "second drop"). Then the monomer mixture (2) shown below was introduced dropwise over 1 hour (referred to as "third drop").

| Monomer mixture (2) | |
|---|---|
| styrene | 20.8 parts |
| butylacrylate | 6.4 parts |
| methacrylic acid | 0.8 part |
| t-butyl peroxyoctate | 1.1 parts |

After the third drop was completed, the reflux was continued 3 hours still further, then the reactant was cooled and the solvent was distilled away thereby to prepare a charge control agent (1). The charge control agent (1) is a block copolymer in which polymer blocks A, B and C were formed in order.

Synthesis of Charge Control Agent (2)

Eighty parts of methylethylketone, 29.2 parts of styrene and 4.3 parts of t-butyl peroxyoctate were poured into a reactor vessel equipped with a stirring blade, a reflux tube and a thermometer, and was heated under nitrogen gas atmosphere at 80° C. for 2 hours, then the monomer mixture (3) shown below was introduced dropwise over 1.5 hours.

| Monomer mixture (3) | |
|---|---|
| styrene | 20.8 parts |
| N-phenyl maleimide | 34.6 parts |
| methylethylketone | 110.0 parts |

After the drop was completed, the monomer mixture (4) shown below was introduced dropwise over 1 hour.

| Monomer mixture (4) | |
|---|---|
| styrene | 21.9 parts |
| butylacrylate | 6.4 parts |
| methacrylic acid | 1.7 parts |
| t-butyl peroxyoctate | 1.1 parts |

After the drop was completed, the reflux was continued at 80° C. for 3 hours, then the reactant was cooled and the solvent was distilled away thereby to prepare a charge control agent (2). The charge control agent (2) is a block copolymer in which polymer blocks B, A and C were formed in order.

Synthesis of Charge Control Agent (3)

Eighty parts of methylethylketone, 38.5 parts of styrene and 10.8 parts of t-butyl peroxyoctate were poured into a reactor vessel equipped with a stirring blade, a reflux tube and a thermometer, and was heated under nitrogen gas atmosphere at 80° C. for 1.5 hours, then the monomer mixture (5) shown below was introduced dropwise over 2 hours.

| Monomer mixture (5) | |
|---|---|
| styrene | 19.8 parts |
| N-phenyl maleimide | 38.1 parts |
| methylethylketone | 120.0 parts |

After the drop was completed, the reflux was continued at 80° C. for 2 hours, then the reactant was cooled and the solvent was distilled away thereby to prepare a charge control agent (3). The charge control agent (3) is a block copolymer in which polymer blocks B and A were formed in order.

Synthesis of Charge Control Agent (4)

Two hundred and fifty parts of diethyleneglycol dimethylether, 29.2 parts of styrene, 45.0 parts of N-phenyl maleimide, and 10.8 parts of t-butyl peroxyoctate were poured into a reactor vessel equipped with a stirring blade, a reflux tube and a thermometer, and was heated under nitrogen gas atmosphere at 80° C. for 2 hours, then 3.9 parts of 2,2,6,6-tetramethyl-1-pyperidinyloxy was added. Then the reactant liquid was heated to 125° C., 41.7 parts of styrene was introduced dropwise over 1 hour. After the drop was completed, the reactant was maintained at 125° C. for 3 hours, followed by cooling and distilling away the solvent using a vacuum drier thereby to prepare a charge control agent (4). The charge control agent (4) is a block copolymer of polymer blocks B synthesized by a living radical polymerization and polymer block A.

Synthesis of Charge Control Agent (5)

One hundred and twenty parts of methylethylketone was poured into a reactor vessel equipped with a stirring blade, a reflux tube and a thermometer, and was heated under nitrogen gas atmosphere. From the stage that the methylethylketone began to reflux, the monomer mixture (6) shown below was introduced dropwise over 2 hours.

| Monomer mixture (6) | |
|---|---|
| styrene | 20.3 parts |
| N-cyclohexyl maleimide | 34.9 parts |
| methylethylketone | 80.0 parts |
| t-butyl peroxyoctate | 10.8 parts |

After the drop was completed, 27.1 parts of styrene was introduced dropwise over 30 minutes, then the monomer mixture (7) shown below was introduced dropwise over 1 hour.

| Monomer mixture (7) | |
|---|---|
| styrene | 21.9 parts |
| butylacrylate | 5.8 parts |
| methacrylic acid | 1.0 part |
| t-butyl peroxyoctate | 1.1 parts |

After the drop was completed, the reflux was continued 3 hours still further, then the reactant was cooled and the solvent was distilled away thereby to prepare a charge control agent (5). The charge control agent (5) is a block copolymer in which polymer block A that contains N-cyclohexyl maleimide, polymer blocks B, C were formed in order.

Synthesis of Charge Control Agent (6)

One hundred and twenty parts of methylethylketone was poured into a reactor vessel equipped with a stirring blade, a reflux tube and a thermometer, and was heated under nitrogen gas atmosphere. From the stage that the methylethylketone began to reflux, the monomer mixture (8) shown below was introduced dropwise over 2 hours.

| Monomer mixture (8) | |
|---|---|
| styrene | 27.1 parts |
| maleic anhydride | 25.5 parts |
| methylethylketone | 80.0 part |
| t-butyl peroxyoctate | 10.8 parts |

After the drop was completed, 26.6 parts of styrene was introduced dropwise over 30 minutes, then the monomer mixture (9) shown below was introduced dropwise over 1 hour.

| Monomer mixture (9) | |
|---|---|
| styrene | 22.9 parts |
| butylacrylate | 5.7 parts |
| t-butyl peroxyoctate | 1.1 parts |

After the drop was completed, the reflux was continued 3 hours still further, then 19.0 parts of N-butylamine was poured and the reactant was refluxed 2 hours still further to progress an imide reaction. Then the reactant was cooled and the solvent was distilled away thereby to prepare a charge control agent (6). The charge control agent (6) is a block copolymer that contains polymer block A having N-butyl maleimide, polymer blocks B and C.

Synthesis of Charge Control Agent (7)

Ninety parts of methylethylketone was poured into a reactor vessel equipped with a stirring blade, a reflux tube and a thermometer, and was heated under nitrogen gas atmosphere. From the stage that the methylethylketone began to reflux, the monomer mixture (10) shown below was introduced dropwise over 2 hours.

| Monomer mixture (10) | |
|---|---|
| styrene | 25.0 parts |
| N-phenyl maleimide | 41.6 parts |
| methylethylketone | 100.0 parts |
| t-butyl peroxyoctate | 8.7 parts |

After the drop was completed, the monomer mixture (11) shown below was introduced dropwise over 1 hour.

| Monomer mixture (11) | |
|---|---|
| styrene | 21.9 parts |
| butylacrylate | 5.8 parts |
| methacrylic acid | 1.0 part |
| t-butyl peroxyoctate | 1.1 parts |

After the drop was completed, the reflux was continued 4 hours still further, then the reactant was cooled and the solvent was distilled away thereby to prepare a charge control agent (7). The charge control agent (7) is a block copolymer formed from only polymer blocks A and C.

Synthesis of Charge Control Agent (8)

One hundred and forty parts of methylethylketone, 53.1 parts of styrene, and 8.0 parts of t-butyl peroxyoctate were poured into a reactor vessel equipped with a stirring blade, a reflux tube and a thermometer, and the mixture was heated under nitrogen gas atmosphere to react at 81° C. for 2 hours, then the monomer mixture (12) shown below was introduced dropwise over 1 hours.

| Monomer mixture (12) | |
|---|---|
| styrene | 24.0 parts |
| butylacrylate | 8.5 parts |
| methacrylic acid | 2.8 part |
| t-butyl peroxyoctate | 1.3 parts |

After the drop was completed, the reflux was continued 4 hours still further, then the reactant was cooled and the solvent was distilled away thereby to prepare a charge control agent (8). The charge control agent (8) is a block copolymer formed from only polymer blocks B and C.

Synthesis of Charge Control Agent (9)

In a boiling solvent of 1,2-dichloroethane, 322 parts of maleic anhydride and 342 parts of styrene were copolymerized using 30 parts of azobisisobutylonitrile as a polymerization initiator, then the 1,2-dichloroethane was distilled away thereby to prepare an intermediate copolymer. Then 664 parts of the intermediate copolymer and 386 parts of m-nitroaniline were subjected to an imidization reaction in a boiling solvent of xylene for 6 hours while distilling away the generating water, then the xylene was distilled away to prepare a charge control agent (9). The charge control agent (9) is a copolymer that contains a copolymer block of styrene and m-nitrophenyl maleimide and a copolymer block of styrene and butylacrylate.

Synthesis of Charge Control Agent (10)

In a boiling solvent of dimethylformamide (DMF), 350 parts of 3,4-dichlorophenylmaleimide and 100 parts of 2-acrylamide-2-methylpropane sulfonic acid were copolymerized for 8 hours with 20 parts of di-t-butylperoxide as an initiator. Then 500 parts of n-butylacrylate and 50 parts of styrene were added and subjected to graft polymerization for 4 hours with 15 parts of di-t-butylperoxide as an initiator, then the DMF was distilled away using a vacuum drier thereby to prepare a charge control agent (10). The charge control agent (10) is a graft copolymer that contains a copolymer block of 3,4-dichlorophenylmaleimide and 2-acrylamide-2-methylpropane sulfonic acid and a copolymer block of n-butylacrylate and styrene.

Example 1

Synthesis of Polyester

Two hundred and thirty-five parts of an adduct of bisphenol A with 2 moles of ethylene oxide, 525 parts of an adduct of bisphenol A with 3 moles of propylene oxide, 205 parts of terephthalic acid, 47 parts of adipic acid, and 2 parts of dibutyltin oxide were poured into a reactor vessel equipped with a condenser, a stirrer and a nitrogen gas inlet, and the mixture was allowed to react at 230° C. for 8 hours under normal pressure, then was further allowed to react under a reduced pressure of 1.3 to 2 kPa (10 to 15 mmHg) for 5 hours, followed by adding 46 parts of trimellitic anhydride into the reactor vessel, and the mixture was allowed to react at 180° C. for 2 hours under normal pressure, thereby to prepare Polyester 1. The Polyester 1 had a number average molecular mass of 2600, a mass average molecular mass of 6900, Tg 44° C., and an acid value of 26.

Synthesis of Prepolymer

Six hundred and eighty-two parts of an adduct of bisphenol A with 2 moles of ethylene oxide, 81 parts of an adduct of bisphenol A with 2 moles of propylene oxide, 283 parts of terephthalic acid, 22 parts of trimellitic anhydride and 2 parts of dibutyltin oxide were poured into a reactor vessel equipped with a condenser, a stirrer and a nitrogen gas inlet, and the mixture was allowed to react at 230° C. for 8 hours under normal pressure and further for 5 hours under a reduced pressure of 1.3 to 2 kPa (10 to 15 mmHg), thereby to prepare Intermediate Polyester 1. The Intermediate Polyester 1 had a number average molecular mass of 2100, a mass average molecular mass of 9500, Tg 55° C., an acid value of 0.5, and a hydroxyl group value of 49.

Thereafter, 411 parts of Intermediate Polyester 1, 89 parts of isophorone diisocyanate and 500 parts of ethyl acetate were poured into a reactor vessel equipped with a condenser, a stirrer and a nitrogen gas inlet, and the mixture was allowed to react at 100° C. for 5 hours to prepare Prepolymer 1. The Prepolymer contained 1.53% by mass of free isocyanate.

Preparation of Master Batch

Forty parts of carbon black (by Cabot Co., Legal 400R), 60 parts of a polyester resin for binder (by Sanyo Kasei Co., RS-801, acid value 10, Mw 20000, Tg 64° C.) and 30 parts of water were mixed by use of a Henschel mixer to prepare a mixture of pigment agglomerates with impregnated water. The mixture was kneaded for 45 minutes by use of two-rolls having a roll surface temperature of 130° C. and was crushed into about 1 mm by use of a pulverizer thereby to prepare Master Batch 1.

Preparation of Pigment-Wax Dispersion (Oil Phase)

Five hundred and forty-five parts of Polyester 1 described above, 181 parts of paraffin wax, and 1450 parts of ethyl acetate were poured into a vessel equipped with a stirring rod and a thermometer, the mixture was heated to 80° C. for 5 hours, then cooled to 30° C. over 1 hour. Then 500 parts of Master Batch 1, 100 parts of the charge control agent (1), and 100 parts of ethyl acetate were poured into a vessel and mixed for 1 hour to prepare Raw Material Solution 1. Fifteen hundred parts of Raw Material Solution 1 was transferred into a vessel, to which a carbon black and a wax were dispersed by a beads mill (IMEX Co., Ultra Visco mill) under the condition of liquid feed rate 1 kg/hr, disc circumferential velocity 6 m/sec, filling rate 80% by volume of 0.5 mm zirconia beads, and 3 pass times. Then a polyester solution of 425 parts of Polyester 1 and 230 parts of ethyl acetate was then passed one time through the beads mill under the same condition as described above to prepare a raw dispersion. An amount of ethyl acetate was then added to the raw dispersion so as to adjust the solid content (base on residual mass after heating at 130° C. for 30 minutes) into 50%, thereby to prepare Pigment-Wax Dispersion 1.

Preparation of Aqueous Phase

Nine hundred and seventy parts of deionized water, 25% by mass of organic resin fine particles for stabilizing dispersion (copolymer of styrene-methacrylic acid-butylacrylate-methacrylic acid-Na salt of adduct of sulfate with ethylene oxide), 40 parts of aqueous dispersion, 140 parts 48.5% aqueous solution of sodium dodecyldiphenylether disulfonate (by Sanyo Chemical Industries Ltd., Eleminol MON-7), and 90 parts of ethyl acetate were mixed and stirred to prepare a creamy white liquid of Aqueous Phase 1.

Preparation of Emulsified Slurry

Nine hundred seventy-five parts of Pigment-Wax Dispersion 1 and 2.6 parts of isophorone diamine were mixed by TK homomixer (by PRIMIX Co.) at 5000 rpm for 1 minute, to which then 88 parts of Prepolymer 1 was added and the mixture was stirred by TK homomixer at 5000 rpm for 1 minute, to which then 1200 parts of Aqueous Phase 1 was added and the mixture was stirred by TK homomixer at 8000 rpm to 13000 rpm for 20 minutes to prepare Emulsified Slurry 1.

Preparation of Dispersion Slurry

Emulsified Slurry 1 was poured into a vessel equipped with a stirrer and a thermometer, then the solvent within Emulsified Slurry 1 was removed at 30° C. for 8 hours thereby to prepare Dispersion Slurry 1.

Preparation of Toner

One hundred parts of Dispersion Slurry 1 was vacuum-filtered to prepare a filter cake, to which one hundred parts of deionized water was added, the mixture was stirred by TK homomixer at 12000 rpm for 10 minutes and then filtered to prepare a washed cake 1. The filtrate was creamy white at this stage. Nine hundred parts of deionized water was added to the washed cake 1, and the mixture was stirred by TK homomixer at 12000 rpm for 30 minutes along with applying ultrasonic vibration, then the slurry was vacuum-filtered to prepare washed cake 2. This operation of the washing-filtering step was repeated till the electric conductivity of the slurry came to 10 μC/cm or less. When the electric conductivity of the slurry came to 10 μC/cm or less, 10% hydrochloride was added to adjust the slurry into pH 4, the slurry was stirred for 30 minutes by a three-one motor, and the slurry was filtered. To the filtered cake, 100 parts of deionized water was added, which was then mixed by TK homomixer at 12000 rpm for 10 minutes and filtered. This operation of the washing-filtering step by use of deionized water was repeated till the electric conductivity of the slurry came to 10 μC/cm or less, thereby to prepare Filter Cake 1. The resulting Filter Cake 1 was dried at 42° C. for 48 hours by a wind-circulation drier, and large particles were removed with a mesh of opening size 75 μm to prepare base toner 101. The base toner had an average circularity of 0.974, volume average particle diameter Dv of 6.3 μm, number average particle diameter Dp of 5.3 μm, and particle diameter distribution Dv/Dp of 1.19. Then 1.8 parts of hydrophobic silica was added to 100 parts of Base Toner 101, thereby to prepare an inventive Toner 1.

Example 2

Preparation of Pigment-Wax Dispersion

Five hundred and seventy parts of Polyester 1 of Example 1, 181 parts of paraffin wax, and 1450 parts of ethyl acetate was poured into a vessel equipped with a stirring rod and a thermometer, the mixture was heated to 80° C. for 5 hours, then cooled to 30° C. over 1 hour. Then 500 parts of Master Batch 1 of Example 1, 390 parts of the charge control agent (2), and 100 parts of ethyl acetate were poured into a vessel and mixed for 1 hour to prepare Raw Material Solution 2. Fifteen hundred parts of Raw Material Solution 2 was transferred into another vessel, to which a carbon black and a wax were dispersed by a beads mill (IMEX Co., Ultra Visco mill) under the condition of liquid feed rate 1 kg/hr, disc circumferential velocity 6 m/sec, filling rate 80% by volume of 0.5 mm zirconia beads, and 3 pass times. Then 425 parts of Polyester 1 of Example 1 was dissolved into 230 parts of ethyl acetate to prepare a polyester solution, which was then passed one time through the beads mill under the same condition as described above to prepare a raw dispersion. An amount of ethyl acetate was then added to the raw dispersion so as to adjust the solid content (base on residual mass after heating at 130° C. for 30 minutes) into 50%, thereby to prepare Pigment-Wax Dispersion 2.

Preparation of Toner

The inventive Toner 2 was prepared in the same manner as Example 1 from the aqueous phase to the preparation of toner except that Pigment-Wax Dispersion 1 was changed into Pigment-Wax Dispersion 2.

Example 3

Preparation of Pigment-Wax Dispersion

Five hundred and forty-five parts of Polyester 1 of Example 1, 181 parts of paraffin wax, and 1450 parts of ethyl acetate was poured into a vessel equipped with a stirring rod and a thermometer, the mixture was heated to 80° C. for 5 hours, then cooled to 30° C. over 1 hour. Then 500 parts of Master Batch 1 of Example 1, 25 parts of the charge control agent (1), and 100 parts of ethyl acetate were poured into a vessel and mixed for 1 hour to prepare Raw Material Solution 3. Fifteen hundred parts of Raw Material Solution 3 was transferred into another vessel, to which a carbon black and a wax were dispersed by a beads mill (IMEX Co., Ultra Visco mill) under the condition of liquid feed rate 1 kg/hr, disc circumferential velocity 6 m/sec, filling rate 80% by volume of 0.5 mm zirconia beads, and 3 pass times. Then 425 parts of Polyester 1 of Example 1 was dissolved into 230 parts of ethyl acetate to prepare a polyester solution, which was then passed one time through the beads mill under the same condition as described above to prepare a raw dispersion. An amount of ethyl acetate was then added to the raw dispersion so as to adjust the solid content (base on residual mass after heating at 130° C. for 30 minutes) into 50%, thereby to prepare Pigment-Wax Dispersion 3.

Preparation of Toner

The inventive Toner 3 was prepared in the same manner as Example 1 from the aqueous phase to the preparation of toner except that Pigment-Wax Dispersion 1 was changed into Pigment-Wax Dispersion 3.

Example 4

Preparation of Toner by Milling

One hundred parts of a polyester resin having a mass average molecular mass of 27000 and an acid value of 18 mgKOH/g, 5 parts of a polyethylene having melting point of 120° C., 5 parts of C.I. Pigment Blue 15:3, and 2 parts of charge control agent (3) were stirred-mixed by a Henschel mixer. Then the mixture was kneaded by a twin-axis extruder, cooled, and milled-classified to prepare Toner Base having a volume average particle diameter of 9±0.5 μm. The temperature of the kneader was controlled such that the temperature of the kneaded product was about 130° C. at the outlet of the kneader. One hundred parts of the Base Toner and 1.2 parts of hydrophobic silica were mixed by a Henschel mixer to prepare an inventive Toner 4.

Example 5

Preparation of Suspension Polymerization Toner

Three hundred and sixty parts of deionized water and 430 parts of 0.1 M sodium phosphate aqueous solution were poured into a four-necked vessel, the mixture was maintained at 60° C. while stirring with a homomixer at 15000 rpm. To the solution, 34 parts of 1M calcium chloride aqueous solution was added gradually thereby to prepare Aqueous Dispersion containing calcium phosphate of a fine hardly-water soluble dispersant.

On the other hand, as for a dispersoid, 83 parts of styrene, 17 parts of n-butylacrylate, 5 parts of Cu phthalocyanine pigment, 2.5 parts of charge control agent (4), 0.05 part of divinylbenzene, 5 parts of ester wax of melting point 75° C., 2 parts of hydrocarbon wax, and 5 parts of a polyester resin of mass average molecular mass 25000 and acid value 15 mgKOH/g were dispersed for 3 hours using Attriter (by Mitsui Kinzoku Co.), then 3 parts of 2,2'-azobis(2,4-dimethylvaleronitrile) was added to prepare a Monomer Composition. Then the Aqueous Dispersion was poured into the Monomer Composition, the mixture was stirred for 4 minutes under nitrogen gas atmosphere of 60° C. while maintaining the rotation number of a high-speed mixer at 15000 rpm thereby to produce particles of the monomer composition. Then the mixer was changed into another mixer equipped with a stirring blade of puddle type, the reactant was polymerized for 5 hours while stirring at 200 rpm at 60° C., then further polymerized at 80° C. After cooling the reactant, pH was adjusted to 1.2 by addition of dilute hydrochloric acid and calcium phosphate was dissolved. The slurry was press-filtered to separate the solid from the liquid, and washed with 18000 parts of water. Then the solid was dried using a vacuum drier to prepare Toner Base Particles of mass average particle diameter 7.1 μm. Then 100 parts of Toner Base Particles and 1.2 parts of hydrophobic silica were mixed by a Henschel mixer to prepare an inventive Toner 5.

Example 6

Preparation of Emulsion Polymerization Toner

Preparation of Anionic Resin Fine Particles Dispersion

Thirty-five parts of deionized water was poured into a reactor vessel, to which 0.43 part of nonionic surfactant Nonipol 400 (by Sanyo Kasei Co.) and 0.59 part of anionic surfactant Neogen R (sodium dodecylbenzene sulfonate) (by Dai-ichi Kogyo Seiyaku Co.) were dissolved. Then a monomer solution containing 25 parts of styrene, 3 parts of n-butylacrylate, 0.56 part of acrylic acid, 1.1 parts of dodecanethiol, and 0.3 part of carbon tetrabromide was dispersed into the solution within the reactor vessel to emulsify, then a solution of 7 parts of deionized water and 0.29 part of ammonium persulfate was added over 10 minutes while stirring slowly the mixture and subjected to nitrogen-exchange, thereby to prepare an emulsion. Thereafter, the emulsion was heated to 70° C. while stirring, and allowed to emulsion-polymerize for 6 hours under this condition, thereby to prepare an anionic Resin Fine Particle Dispersion 1 of which the resin fine particles had an average particle diameter of 210 nm, a glass transition temperature of 57° C. and a mass average molecular mass of 16500.

Thirty-five parts of deionized water was poured into a reactor vessel, to which 0.43 part of nonionic surfactant Nonipol 400 (by Sanyo Kasei Co.) and 0.9 part of anionic surfactant Neogen R (by Dai-ichi Kogyo Seiyaku Co.) were dissolved. Then a monomer solution containing 19.4 parts of styrene, 8.3 parts of n-butylacrylate, and 0.57 part of acrylic acid was dispersed into the solution within the reactor vessel to emulsify, then a solution of 7 parts of deionized water and 0.15 part of ammonium persulfate was added over 10 minutes while stirring slowly the mixture and subjected to nitrogen-exchange, thereby to prepare an emulsion. Thereafter, the emulsion was heated to 70° C. while stirring, and allowed to emulsion-polymerize for 6 hours under this condition, thereby to prepare an anionic Resin Fine Particle Dispersion 2 of which the resin fine particles had an average particle diameter of 190 nm, a glass transition temperature of 55° C. and a mass average molecular mass of 830000.

Preparation of Colorant Dispersion

Fifty parts of a cyan pigment of C.I. Pigment Blue 15:3 (by Dainippon Ink and Chemicals, Inc.), 5 parts of an anionic surfactant Neogen R (by Dai-ichi Kogyo Seiyaku Co.) and 200 parts of water were mixed, and the mixture was predispersed for 10 minutes by use of a homogenizer Ultratalacs (IKA Co.), and dispersed for 2 hours by use of a sand mill, thereby to prepare Colorant Dispersion having a central diameter of 140 nm and a solid content of 21.5% by mass.

Preparation of Dispersion of Charge Control Agent

Fifty parts of charge control agent (1), 3 parts of an anionic surfactant Neogen R (by Dai-ichi Kogyo Seiyaku Co.) and 200 parts of water were mixed, and the mixture was predispersed for 10 minutes by use of a homogenizer Ultratalacs (IKA Co.), and dispersed for 2 hours by use of a sand mill, thereby to prepare Charge Control Agent Dispersion having a solid content of 21.1% by mass.

Release Agent Dispersion having an average particle diameter of 250 nm was prepared by way of mixing 7.0 parts of paraffin wax HNPO190 with melting point 85° C. (by Nippon Seiro Co.), 1.1 parts of an anionic surfactant Neogen R (by Dai-ichi Kogyo Seiyaku Co.) and 18 parts of deionized water were mixed, heated to 95° C., and dispersion-treated by use of a high-pressure homogenizer.

Preparation of Agglomerating Agent Aqueous Solution

Agglomerating Agent Aqueous Solution was prepared by way of mixing-stirring 0.18 part of polyaluminum chloride PAC (by Asada Chemical Industry Co.) and 1.8 parts of 0.1% by mass of nitric acid aqueous solution in a bottle.

Preparation of Toner

A stirring-dispersing device of inline type was used for stirring-dispersing. The device is constructed from the stirring bath, a loop line that circulates from the bottom to the top of the bath, and a dispersing device Cabitron CD1010 (by Taiheiyo Kikou Co.) inserted on the way of the line; the stirring bath is equipped with a jacket to cool the stirring bath by cooling water. Using the stirring-dispersing device of inline type, a mixture liquid consisting of 8.35 parts of Resin Fine Particles Dispersion 1, 5.5 parts of Resin Fine Particles Dispersion 2, 2.1 parts of Colorant Dispersion, 0.6 part of Charge Control Agent Dispersion, 2.8 parts of Release Agent Dispersion, and 43 parts of deionized water was sufficiently mixed in a stirring bath, then the mixture liquid was introduced into the dispersing device from a bottom valve of the stirring bath while adding gradually 1.5 parts of the Agglomerating Agent Aqueous Solution, which was dispersed at a circumferential speed (outermost speed of rotor) of 36 m/sec and the mixture liquid, passed through the dispersing device, was circulated to the top of the stirring bath for 10 minutes. The agglomeration particles in the mixture liquid after the stirring and dispersing were measured by Coulter Counter Multisizer II (by Beckman Coulter, Inc.), consequently, the volume average particle diameter was 3.2 μm. The temperature of the mixture liquid was 32° C.

The mixture liquid was heated to 53° C. using a stirring bath equipped with a heating jacket and was maintained for 90 minutes. The Mixture Liquid 1 after this heating treatment was measured by Coulter Counter Multisizer II, consequently, agglomerated particles were determined to have a volume average particle diameter of 7.4 μm. 4.3 parts of Resin Fine Particles Dispersion 1 was mildly added to the Mixture Liquid 1 and allowed to stand for 1 hour, which was named as Mixture Liquid 2. The particles in the Mixture Liquid 2 were confirmed to be agglomerated particles having a volume average particle diameter of 7.9 μm. 1.5 parts of 4% by mass of sodium hydroxide aqueous solution was added to the Mixture Liquid 2 and the mixture was heated to 95° C. for 4 hours, thereby the agglomerated particles were fused. Then the slurry was cooled and filtered with a nylon mesh of pore diameter 20 μm and further filtered by a filter cloth of pore diameter 3 μm; then the filter cake on the filter cloth was rinsed by use of sufficient deionized water and dried by a vacuum drier to obtain Toner Base Particles. The Toner Base Particles had a volume average particle diameter of 7.8 μm. 100 parts of the Toner Base Particles and 1.6 parts of hydrophobic silica were mixed by a Henschel mixer to prepare an inventive Toner 6.

Example 7

Toner Produced by Emulsion Polymerization Agglomeration Process

Preparation of Colorant Dispersion

Fifty parts of C.I. Pigment Blue 15:3 as a cyano pigment, 10 parts of sodium dodecylsulfate and 200 parts of deionized water were dispersed by a sand grinder mill to prepare a Colorant Dispersion having a volume average particle diameter of 170 nm.

Preparation of Latex

A solution of 4.05 parts of sodium dodecylsulfate and 2500 parts of deionized water was poured into a separable flask of 5000 mL equipped with a stirring device, a thermosensor, a condenser, and a nitrogen gas inlet, then the solution was heated to 80° C. while stirring at 230 rpm under nitrogen gas atmosphere. Then a solution of 9.62 parts of potassium persulfate and 200 parts of deionized water was added, and a mixture of 568 parts of styrene, 164 parts of n-butylacrylate, 68 parts of methacrylic acid, and 16.51 parts of n-octylmercaptan was introduced dropwise over 1.5 hours, and the mixture was heated-stirred at 80° C. for 2 hours to polymerize (first polymerization) thereby to prepare Latex (1H). The mass average particle diameter of the Latex (1H) was 68 nm. A total of 123.81 parts of styrene, 39.51 parts of n-butylacrylate, 12.29 parts of methacrylic acid, 0.72 part of n-octylmercaptan, and 70 parts of an ester wax (chemical formula: $C(CH_2OCO(CH_2)_{20}CH_3)_4$) and 20 parts of the charge control agent (2) were poured into a flask equipped with a stirrer, the mixture was then heated to 80° C. and dissolved to prepare a monomer solution.

A solution of 0.6 part of a surfactant (chemical formula: $C_{10}H_{21}(OCH_2CH_2)_2OSO_3—Na^+$) and 2700 parts of deionized water was heated to 98° C., to which 32 parts as solid content of Latex (1H) was added and also the monomer solution was added, then the mixture was mixed-dispersed for 8 hours by use of a mechanical dispersing device of Kurea Mix (by M technique Co.) having a circulating path to prepare a dispersion. A solution of 6.12 parts of potassium persulfate and 250 parts of deionized water was added to the dispersion, and the mixture was heated-stirred at 82° C. for 12 hours to polymerize (second polymerization) thereby to prepare Latex (1HM).

A solution of 8.8 parts of potassium persulfate and 350 parts of deionized water was added to the Latex (1HM), then a mixture of 350 parts of styrene, 95 parts of n-butylacrylate, 5 parts of methacrylic acid, and 1 mol % of n-octylmercaptan was introduced dropwise over 1 hour. After the drop, the mixture was heated-stirred at 82° C. for 2 hours to polymerize (third polymerization) and then cooled to 28° C. thereby to prepare Latex (1HML).

Preparation of Toner

Four hundred and twenty parts of Latex (1HML) (as solid content), 900 parts of deionized water and 150 parts of Colorant Dispersion were poured into a four-necked reactor vessel equipped with a thermosensor, a condenser, a nitrogen inlet device and a stirrer, and the mixture was stirred. The temperature in the reactor vessel was adjusted to 30° C., then pH was adjusted to 8 to 10 through adding 5N aqueous solution of sodium hydroxide. Then a solution of 65 parts of magnesium chloride hexahydrate and 1000 parts of deionized water was added over 10 minutes while stirring. After allowing to stand for 3 minutes, the reactant was heated to 92° C. to form agglomerated particles. At this stage, the particle diameter of the agglomerated particles was measured by Coulter counter TA-II (by Beckman Coulter, Inc.); when the number average particle diameter came to 6.8 μm, a solution of 80.4 parts of sodium chloride and 1000 parts of deionized water was added to stop the particle growth. The slurry was heated and stirred at 94° C. to allow the fusion-bond of particles and phase separation of crystalline substances. At this stage, shape of the fused-bonded particles was measured by use of FPIA-2000 (by Sysmex Co.) and the temperature of the slurry was cooled to 30° C. and the stirring was stopped when the average circularity came to 0.961. The resulting fused-bonded particles were filtered and washed repeatedly by deionized water at 45° C. and dried by warm wind at 40° C. thereby to prepare toner base particles. The number average particle diameter and the shape factor of the toner base particles were measured again, consequently to be 6.6 μm and 0.962. Then 100 parts of the toner base particles and 1.6 parts of the hydrophobic silica were mixed by a Henschel mixer to prepare an inventive Toner 7.

Example 8

Preparation of Raw Material Solution

One hundred and ninety parts of Polyester 1 of Example 1, 85 parts of paraffin wax, and 1450 parts of ethyl acetate were poured into a vessel equipped with a stirring rod and a thermometer, and the mixture was heated to 80° C. for 5 hours, then cooled to 30° C. over 1 hour. Then 500 parts of Master Batch 1 of Example 1, 420 parts of charge control agent (1), and 100 parts of ethyl acetate were poured into the vessel to mix for one hour, thereby to obtain Raw Material Solution 8.

Preparation of Pigment-Wax Dispersion

Then 1500 parts of Raw Material Solution 8 was poured into a vessel, and a carbon black and a wax were dispersed by a beads mill (IMEX Co., Ultra Visco mill) under the condition of liquid feed rate 1 kg/hr, disc circumferential velocity 6 m/sec, filling rate 80% by volume of 0.5 mm zirconia beads, and 3 pass times. Then 425 parts of Polyester 1 of Example 1 was dissolved into 230 parts of ethyl acetate to prepare a polyester solution, which was then passed one time through the beads mill under the same condition as described above to prepare a raw dispersion. An amount of ethyl acetate was then added to the raw dispersion so as to adjust the solid content (base on residual mass after heating at 130° C. for 30 minutes) into 50%, thereby to prepare Pigment-Wax Dispersion 8.

Preparation of Toner

The inventive Toner 8 was prepared in the same manner Example 1 from the aqueous phase to the preparation of toner except that Pigment-Wax Dispersion 1 was changed into Pigment-Wax Dispersion 8.

Example 9

Preparation of Raw Material Solution

Five hundred and forty-five parts of Polyester 1 of Example 1, 105 parts of paraffin wax, and 1450 parts of ethyl acetate were poured into a vessel equipped with a stirring rod and a thermometer, the mixture was heated to 80° C. for 5 hours, then cooled to 30° C. over 1 hour. Then 500 parts of Master Batch 1 of Example 1, 15 parts of charge control agent (2), and 100 parts of ethyl acetate were poured into the vessel to mix for 1 hour, thereby to obtain Raw Material Solution 9.

Preparation of Pigment-Wax Dispersion

Then 1500 parts of Raw Material Solution 9 was poured into a vessel, and a carbon black and a wax were dispersed by a beads mill (IMEX Co., Ultra Visco mill) under the condition of liquid feed rate 1 kg/hr, disc circumferential velocity 6 m/sec, filling rate 80% by volume of 0.5 mm zirconia beads, and 3 pass times. Then 425 parts of Polyester 1 of Example 1 was dissolved into 210 parts of ethyl acetate to prepare a polyester solution, which was then passed one time through the beads mill under the same condition as described above to prepare a raw dispersion. An amount of ethyl acetate was then added to the raw dispersion so as to adjust the solid content (base on residual mass after heating at 130° C. for 30 minutes) into 50%, thereby to prepare Pigment-Wax Dispersion 9.

Preparation of Toner

The inventive Toner 9 was prepared in the same manner as Example 1 from the aqueous phase to the preparation of toner except that Pigment-Wax Dispersion 1 was changed into Pigment-Wax Dispersion 9.

Example 10

The inventive Toner 10 was prepared in the same manner as Example 1 except that the charge control agent (1) was changed into the charge control agent (5).

Example 11

The inventive Toner 11 was prepared in the same manner as Example 1 except that the charge control agent (1) was changed into the charge control agent (6).

Comparative Example 1

The Toner 101 was prepared in the same manner as Example 1 except that the charge control agent (1) was changed into the charge control agent (7).

Comparative Example 2

The Toner 102 was prepared in the same manner as Example 1 except that the charge control agent (1) was changed into the charge control agent (8).

Comparative Example 3

Preparation of Raw Material Liquid

Five hundred and forty-five parts of Polyester 1 of Example 1, 181 parts of paraffin wax, and 1450 parts of ethyl acetate were poured into a vessel equipped with a stirring rod and a thermometer, the mixture was heated to 80° C. for 5 hours, then cooled to 30° C. over 1 hour. Then 500 parts of Master Batch 1 of Example 1, 50 parts of charge control agent (7), 50 parts of charge control agent (8), and 100 parts of ethyl acetate were poured into the vessel to mix for 1 hour, thereby to obtain Raw Material Solution 103.

Preparation of Pigment-Wax Dispersion

Then 1500 parts of Raw Material Solution 103 was poured into a vessel, and a carbon black and a wax were dispersed by a beads mill (IMEX Co., Ultra Visco mill) under the condition of liquid feed rate 1 kg/hr, disc circumferential velocity 6 m/sec, filling rate 80% by volume of 0.5 mm zirconia beads, and 3 pass times. Then 425 parts of Polyester 1 of Example 1 was dissolved into 230 parts of ethyl acetate to prepare a polyester solution, which was then passed one time through the beads mill under the same condition as described above to prepare a raw dispersion. An amount of ethyl acetate was then added to the raw dispersion so as to adjust the solid content (base on residual mass after heating at 130° C. for 30 minutes) into 50%, thereby to prepare Pigment-Wax Dispersion 103.

Preparation of Toner

A Toner 103 was prepared in the same manner as Example 1 except that Pigment-Wax Dispersion 1 was changed into Pigment-Wax Dispersion 103.

Comparative Example 4

A Toner 104 was prepared in the same manner as Example 1 except that the charge control agent (1) was changed into the charge control agent (9).

Comparative Example 5

A Toner 105 was prepared in the same manner as Example 1 except that the charge control agent (1) was changed into the charge control agent (10).

Evaluation of Toner

The toners prepared in Examples and Comparative Examples were evaluated by use of an electrophotographic image forming apparatus in terms of the items shown below. The charge amount, background smear resistance L*, CCA amount, and entire evaluation of charging ability are shown in Table 1.

Charge Amount

Using the external-treated toners (developers), a specific print pattern of 6% B/W was printed by an image forming apparatus (by Ricoh Co., printer IPSIO CX2500) under a N/N condition of 23° C. and 45%. A blank pattern was printed under the N/N condition after the first printing and after continuous 1000 printings (after durability), the toner on the developing roller was vacuumed when printing a blank pattern, the charge amount was measured by an electrometer, the charge amount of the first and the 1000th printing was determined. Preferably, the absolute amount of the charge amount is 15 to 35μC/g, particularly preferably 20 to 30 μC/g.

Background Smear Resistance

Using additive-treated black toners, a specific print pattern of 6% B/W was printed by use of an image forming apparatus (by Ricoh Co., printer IPSIO CX2500) under a H/H condition of 28° C. and 80% and a L/L condition of 10° C. and 15%. A blank pattern was printed after the first printing and after continuous 1000 printings (after durability), a transparent tape was attached to the photoconductor which was printing the blank pattern, and the tape was peeled and adhered to a white paper, which was then measured in terms of L* by use of a color meter to determine the background smear resistance L*. Preferably, the background smear resistance L* is 88 or higher, more preferably 90 or higher.

Entire Evaluation of Charging Ability

The evaluation criteria are as follows:

A: 25 μC/g≦absolute value of charging amount (AVCA)≦30μC/g, image density can be easily controlled by developing bias, L* is 90 or higher, and image quality is high;

B: 20 μC/g≦AVCA<25 μC/g, and image density can be relatively easily controlled by developing bias; alternatively, 88≦L*<90, and image quality is not so problematic;

C: 15 μC/g≦AVCA<20 μC/g, and image density is somewhat hard to control by developing bias; alternatively, 85≦L*<88, and some background smear is recognized at blank portions of images;

D: AVCA<15 μC/g, and sufficient image density is not obtainable; alternatively, L*<85, and significant background smear is recognized at blank portions of images.

TABLE 1

| | | Charge Control Agent | | Charge Amount | | Background Smear Resistance L* | | Entire Evaluation of Charging Ability | | Toner Production |
|---|---|---|---|---|---|---|---|---|---|---|
| | Toner | No. | amount (%) | 1st | 1000th | 1st | 1000th | 1st | 1000th | Process |
| Ex. 1 | 1 | 1 | 2.3 | 29 | 26 | 92 | 91 | A | A | DPS |
| Ex. 2 | 2 | 2 | 17.3 | 25 | 29 | 90 | 91 | A | A | DPS |
| Ex. 3 | 3 | 1 | 1.1 | 24 | 23 | 90 | 90 | B | B | DPS |
| Ex. 4 | 4 | 3 | 1.8 | 27 | 25 | 92 | 90 | A | A | MP |
| Ex. 5 | 5 | 4 | 2.0 | 27 | 24 | 92 | 91 | A | B | SPP |
| Ex. 6 | 6 | 1 | 1.9 | 25 | 23 | 91 | 90 | A | B | EPAP |
| Ex. 7 | 7 | 2 | 2.5 | 24 | 22 | 91 | 91 | B | B | EPAP |

TABLE 1-continued

| | | Charge Control Agent | | Charge | | Background Smear Resistance | | Entire Evaluation of Charging | | Toner |
|---|---|---|---|---|---|---|---|---|---|---|
| | | | amount | Amount | | L* | | Ability | | Production |
| | Toner | No. | (%) | 1st | 1000th | 1st | 1000th | 1st | 1000th | Process |
| Ex. 8 | 8 | 1 | 24.1 | 21 | 16 | 90 | 88 | B | C | DPS |
| Ex. 9 | 9 | 2 | 0.7 | 19 | 16 | 89 | 88 | C | C | DPS |
| Ex. 10 | 10 | 5 | 2.2 | 28 | 27 | 91 | 91 | A | A | DPS |
| Ex. 11 | 11 | 6 | 2.2 | 29 | 28 | 92 | 91 | A | A | DPS |
| Com. Ex. 1 | 101 | 7 | 2.2 | 17 | 11 | 86 | 82 | C | D | DPS |
| Com. Ex. 2 | 102 | 8 | 2.2 | 15 | 13 | 85 | 83 | C | D | DPS |
| Com. Ex. 3 | 103 | 7 + 8 | 2.2 | 15 | 13 | 85 | 83 | C | D | DPS |
| Com. Ex. 4 | 104 | 9 | 2.2 | 21 | 12 | 89 | 81 | B | D | DPS |
| Com. Ex. 5 | 105 | 10 | 2.2 | 23 | 13 | 90 | 83 | B | D | DPS |

DSP: dissolving-suspending process,
SPP: suspension polymerization process
MP: milling process,
EPAP: emulsion polymerization agglomeration process Although the invention has been described in detail with reference to certain preferred embodiments and Examples for the purpose of illustration, it is to be understood that variations and modifications can be made by those skilled in the art without departing from the spirit and scope of the invention.

The inventive toners, toner-supplying cartridges, process cartridges and image forming apparatuses can be applied to electrophotographic developing apparatuses and image forming apparatuses such as printers, facsimiles, and digital photograph developing devices.

What is claimed is:

1. A charge control agent comprising a copolymer, wherein the copolymer comprises a polymer block A and a polymer block B, said polymer block A being prepared by copolymerizing a maleimide and styrene or a styrene derivative, wherein a hydrogen atom of an imide group of the maleimide is unsubstituted or substituted with a hydrocarbon group or an electron-donating group, with the proviso that the hydrogen atom of the imide group of the maleimide is not substituted with an electron-attractive group, and the polymer block B is a polymer of styrene or a styrene derivative.

2. The charge control agent according to claim 1, wherein the copolymer further comprises a polymer block C that is different from the polymer blocks A and B.

3. A toner, comprising a binder resin, a colorant and a charge control agent, wherein the charge control agent comprises a copolymer that comprises a polymer block A and a polymer block B, said polymer block A being prepared by copolymerizing a maleimide and styrene or a styrene derivative, wherein a hydrogen atom of an imide group of the maleimide is unsubstituted or substituted with a hydrocarbon group or an electron-donating group, with the proviso that the hydrogen atom of the imide group of the maleimide is not substituted with an electron-attractive group, and the polymer block B is a polymer of styrene or a styrene derivative.

4. The toner according to claim 3, wherein the content of the charge control agent is 1% by mass to 20% by mass.

5. A toner producing method comprising:

dispersing toner materials comprising a charge control agent, a binder resin and a colorant into water or an aqueous dispersing medium, and agglomerating and fusing the dispersion of toner materials that is dispersed into the water or the aqueous dispersing medium, wherein the charge control agent comprises a copolymer that comprises a polymer block A and a polymer block B, said polymer block A being prepared by copolymerizing a maleimide and styrene or a styrene derivative, wherein a hydrogen atom of an imide group of the maleimide is unsubstituted or substituted with a hydrocarbon group or an electron-donating group, with the proviso that the hydrogen atom of the imide group of the maleimide is not substituted with an electron-attractive group, and the polymer block B is a polymer of styrene or a styrene derivative.

6. An image forming method comprising:

forming a latent image on an image bearing member, developing the latent image into a toner image by use of a toner, transferring the developed toner image onto a transfer body, and fixing the toner image transferred onto the transfer body, wherein, the toner comprises a binder resin, a colorant and a charge control agent, the charge control agent comprises a copolymer that comprises a polymer block A and a polymer block B, said polymer block A being prepared by copolymerizing a maleimide and styrene or a styrene derivative, wherein a hydrogen atom of an imide group of the maleimide is unsubstituted or substituted with a hydrocarbon group or an electron-donating group, with the proviso that the hydrogen atom of the imide group of the maleimide is not substituted with an electron-attractive group, and the polymer block B is a polymer of styrene or a styrene derivative.

7. The charge control agent according to claim 1, wherein the hydrogen atom of the imide group of the maleimide is substituted with one group selected from the group consisting of an unsubstituted phenyl group, an unsubstituted naphthyl group, an unsubstituted cyclopentyl group, an unsubstituted cyclohexyl group, a substituted phenyl group, a substituted naphthyl group, a substituted cyclopentyl group, and a substituted cyclohexyl group, wherein said substituted groups are substituted by at least one group selected from the group consisting of a methyl group, an ethyl group, a propyl group, an isopropyl group, a butyl group, a hexyl group, an octyl group, a 2-ethylhexyl group, a dodecyl group, a stearyl group, and a behenyl group.

8. The toner according to claim 3, wherein the hydrogen atom of the imide group of the maleimide is substituted with one group selected from the group consisting of an unsubstituted phenyl group, an unsubstituted naphthyl group, an unsubstituted cyclopentyl group, an unsubstituted cyclohexyl group, a substituted phenyl group, a substituted naphthyl group, a substituted cyclopentyl group, and a substituted cyclohexyl group, wherein said substituted groups are substituted by at least one group selected from the group consisting of a methyl group, an ethyl group, a propyl group, an isopropyl group, a butyl group, a hexyl group, an octyl group, a 2-ethylhexyl group, a dodecyl group, a stearyl group, and a behenyl group.

9. The toner producing method according to claim 5, wherein the hydrogen atom of the imide group of the maleimide is substituted with one group selected from the group consisting of an unsubstituted phenyl group, an unsubstituted naphthyl group, an unsubstituted cyclopentyl group, an unsubstituted cyclohexyl group, a substituted phenyl group, a substituted naphthyl group, a substituted cyclopentyl group, and a substituted cyclohexyl group, wherein said substituted groups are substituted by at least one group selected from the group consisting of a methyl group, an ethyl group, a propyl group, an isopropyl group, a butyl group, a hexyl group, an octyl group, a 2-ethylhexyl group, a dodecyl group, a stearyl group, and a behenyl group.

10. The image forming method according to claim 6, wherein the hydrogen atom of the imide group of the maleimide is substituted with one group selected from the group consisting of an unsubstituted phenyl group, an unsubstituted naphthyl group, an unsubstituted cyclopentyl group, an unsubstituted cyclohexyl group, a substituted phenyl group, a substituted naphthyl group, a substituted cyclopentyl group, and a substituted cyclohexyl group, wherein said substituted groups are substituted by at least one group selected from the group consisting of a methyl group, an ethyl group, a propyl group, an isopropyl group, a butyl group, a hexyl group, an octyl group, a 2-ethylhexyl group, a dodecyl group, a stearyl group, and a behenyl group.

* * * * *